US008226186B2

(12) United States Patent
Ooishi et al.

(10) Patent No.: US 8,226,186 B2
(45) Date of Patent: Jul. 24, 2012

(54) INKJET RECORDING METHOD

(75) Inventors: Yasufumi Ooishi, Kanagawa (JP); Kiyoshi Irita, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 298 days.

(21) Appl. No.: 12/642,340

(22) Filed: Dec. 18, 2009

(65) Prior Publication Data

US 2010/0165018 A1 Jul. 1, 2010

(30) Foreign Application Priority Data

Dec. 26, 2008 (JP) ..... 2008-334492

(51) Int. Cl.
*B41J 2/195* (2006.01)

(52) U.S. Cl. ..... 347/7

(58) Field of Classification Search ..... 347/6, 7, 347/95, 100

See application file for complete search history.

(56) References Cited

U.S. PATENT DOCUMENTS 7,681,978 B2 * 3/2010 Hirato ..... 347/19
2004/0030001 A1 2/2004 Ma et al.

FOREIGN PATENT DOCUMENTS

JP 2004-59933 A 2/2004
JP 2008-200855 A 9/2008

* cited by examiner

*Primary Examiner* — An Do

(74) *Attorney, Agent, or Firm* — Birch Stewart Kolasch & Birch, LLP

(57) ABSTRACT

An inkjet recording method including recording an image by applying an ink containing a pigment to a recording medium, and fixing an image region by pressure-contacting a pressure-bonding unit against the image region when the tackiness of the image region as measured by a ball tack test method reaches 20 mm or greater.

15 Claims, 1 Drawing Sheet

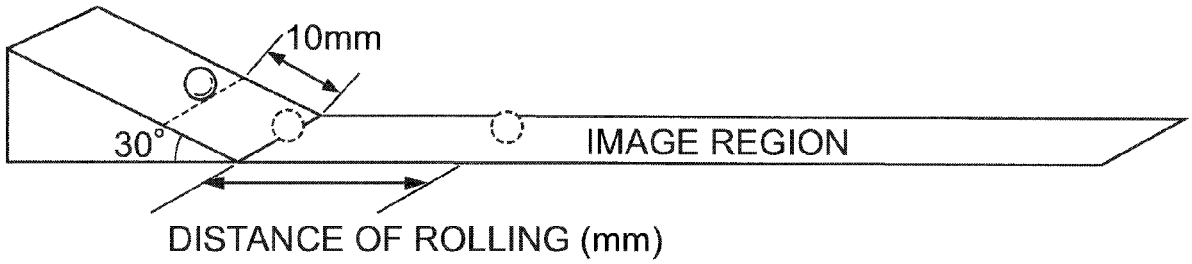
10mm
30°
IMAGE REGION
DISTANCE OF ROLLING (mm)

INKJET RECORDING METHOD

CROSS-REFERENCE TO RELATED APPLICATION

This Application claims priority under 35 USC 119 from Japanese Patent Application No. 2008-334492, filed on Dec. 26, 2008, the disclosure of which is incorporated by reference herein.

BACKGROUND OF THE INVENTION

1. Field of Invention

The present invention relates to an inkjet recording method of recording images by applying ink to a recording medium by an inkjet method.

2. Description of the Related Art

Various methods have been proposed for image recording methods for recording color images in recent years. However, in all of these methods, there are still demands on the quality levels of recorded objects, for example, in relation to quality of image, texture, and curling properties after recording.

The inkjet technique has been applied for office printers and household printers, and is recently increasingly being applied in the field of commercial printing. In the commercial printing field, printed sheets are required to have an appearance similar to that of general printing paper, rather than a surface that completely blocks penetration of ink solvent into the base paper such as that of a photograph. However, when a solvent absorption layer of a recording medium has a thickness from 20 μm to 30 μm, the properties such as surface gloss, texture and stiffness are limited. Therefore, the application of inkjet techniques in commercial printing has been limited to, for example, posters and forms, for which the qualities on surface gloss, texture, stiffness and the like of a printing medium are tolerable.

Furthermore, a recording medium for exclusive use in inkjet recording is expensive since it is provided with a solvent absorbing layer and a water resistant layer, and this is also a factor that limits the application of inkjet technology in the field of commercial printing.

As an inkjet recording method for forming high quality images, an image recording method in which a liquid composition for improving images is prepared in addition to an usual inkjet ink, and the liquid composition is deposited on a recording medium prior to the ejection of the inkjet ink, has been proposed (see, for example, Japanese Patent Application Laid-Open (JP-A) No. 2004-59933). In this method, the components of the inkjet ink are aggregated on the surface of paper by a component in the liquid component, and thus the ink is fixed before dullness or bleeding on the image occurs.

From the viewpoint of accelerating the penetration of ink solvent into a recording medium, there is known a technique of using a penetration liquid for accelerating the penetration of the ink solvent into the recording medium wherein the penetration liquid contains a surfactant, or a technique of fixing image areas in order to enhance performance such as the gloss of the image areas (see, for example, JP-A No. 2008-200855).

SUMMARY OF THE INVENTION

According to an aspect of the present invention, an inkjet recording method includes:

recording an image by applying an ink including a pigment to a recording medium; and fixing an image region by pressure-contacting a pressure-bonding unit against the image region when the tackiness of the image region as measured by a ball tack test method reaches 20 mm or greater.

BRIEF DESCRIPTION OF THE DRAWINGS

FIG. 1 is a diagram showing a method of performing measurement according to a ball tack test method.

DETAILED DESCRIPTION OF THE INVENTION

In the conventional recording methods or technologies described above, when the recording speed is further enhanced, recording quality cannot be maintained. A high tackiness of an image region may result in offset of an image region when the time between printing and fixing is short in a recording system in which a member contacts a printed image after an image is formed by ink ejection. An example of such a recording system is a recording system in which a printed image is fixed by pressure bonding while heating. The present invention has been made in view of the above circumstances.

Hereinafter, the inkjet recording method of the invention will be described in detail.

The inkjet recording method of the invention includes (i) an image recording process in which an image is recorded by applying an ink containing a pigment to a recording medium, and (ii) a fixing process in which an image region is fixed by pressure-contacting a pressure-bonding unit against the image region when the tackiness of the image region according to a ball tack test method reaches 20 mm or greater. Preferably, the inkjet recording method further includes (iii) a treatment liquid applying process of applying a treatment liquid containing an aggregating agent capable of aggregating components of the ink, onto the recording medium. The inkjet recording method of the invention may also include other processes such as an ink drying process of drying and removing an organic solvent contained in the ink that has been applied to a coated paper, if necessary.

According to the invention, fixation of an image region in image recording is initiated when the tackiness of the image region is within a specific range, in consideration of a significant temporal change of the tackiness of the image region obtained by jetting ink to the recording medium, as a result of which offset of an image region is prevented. Thus, image fixation can be performed rapidly, allowing an enhancement of the recording speed. Thereby, fine lines or fine image portions, for example, can be formed with high resolution and uniformly while preventing deterioration of the texture of the final image surface due to a change in the paper surface such as roughening of the surface. When ink is applied onto a large area such as in solid image recording, generation of image unevenness is suppressed; an image having highly uniform image density can be obtained, and image texture such as glossiness and abrasion resistance (for example, adhesion to the paper) are also improved. Furthermore, high density image recording is also possible, and the color reproducibility of the image is also improved.

In particular, the inkjet recording method of the invention is effective when using a coated paper having a coating layer, such as art paper or coat paper, as a recording medium, and/or when forming an image using an ink and a treatment liquid containing an aggregating agent capable of aggregating components of the ink.

The tackiness of the image region before fixing the image region is 20 mm or greater when measured by a ball tack test method, in order to achieve a desired offset resistance. Furthermore, from the viewpoint of further increasing the recording speed while obtaining satisfactory offset resistance and maintaining excellent image quality, it is preferable that the tackiness of the image region measured by a ball tack test method increases to 20 mm or greater within 7 seconds of the completion of recording (image formation). In particular, the tackiness before the image region is fixed is preferably 30 mm or greater, more preferably 40 mm or greater, and particularly preferably 50 mm or greater, as measured by the ball tack test method. Furthermore, the time it takes for the tackiness of the image region measured by the ball tack test method to become 20 mm or greater is preferably within 7 seconds, more preferably within 5 seconds, even more preferably within 3 seconds, and particularly preferably within 1 second, of the completion of image forming.

Here, the (time of) completion of recording (image formation) means (the time of) deposition of the last ink droplet on the recording medium.

Here, the tackiness of the image region is measured by the ball tack test method shown in FIG. 1. The ball tack test is conducted as follows. A slope having an inclination angle of 30 degrees is disposed at one end of the image region, and a ball made of SUS (stainless steel) with a diameter of 2 mm (mass: 0.326 to 0.328 g, ball surface: mirror surface) is allowed to roll down the slope from a point that is located at a slope distance of 10 mm (at a height of 5 mm) from the image region under an environment at 23° C. and 50% RH. The distance that the ball made of SUS rolls over the image region is measured. The maximum length of the distance is taken as an index representing the tackiness of the image region. A higher tackiness means a shorter rolling distance, while a lower tackiness means a longer rolling distance.

Examples of the method for adjusting the tackiness of the image region measured by the ball tack test method to 20 mm or greater include (a) a method of accelerating the penetration of the solvent and water from the image region into the recording medium and/or the penetration of the treatment liquid into the recording medium; (b) a method of increasing the solid content concentration of the ink (image region); (c) a method of accelerating drying of the image region (including the treatment liquid and the ink); and (d) a method of selecting at least one of a resin particle, a pigment dispersant, a water-soluble organic solvent or the like suitable to reduce the tackiness of the image region. The details of these methods are described below.

In the inkjet recording method of the invention, either one of a treatment liquid applying process or an image recording process may be performed before the other one of the treatment liquid applying process or the image recording process. An embodiment is preferable from the viewpoint of enhancing image quality, offset resistance and abrasion resistance by improving the resolution and uniformity in printing fine lines or fine image portions or by reducing the occurrence of image unevenness as much as possible when an ink is applied to a wide region, such as when recording a solid image, and thereby further increasing the density uniformity. In the embodiment, (iii) the treatment liquid applying process is performed in which a treatment liquid is applied to a recording medium (the treatment is preferably coated on paper, preferably over the entire surface of the paper), and then (i) the image recording process is performed in which an image is formed by applying ink, and then the printed image region is fixed in the (ii) fixing process.

<Recording Medium>

In the inkjet recording method of the invention, a recording medium may be arbitrarily selected from known recording media. Coated paper, which is used in general offset printing or the like, is preferred in that the effects of the present invention are more conspicuous. The coated paper is a product obtained by applying a coating material to at least one surface of high quality paper, neutral paper or the like, which is mainly made of cellulose and is generally not surface-treated, to provide a coating layer.

When these general printing papers are used in the formation of images by conventional aqueous ink jet method, the general printing papers tend to cause problems in terms of image quality, such as insufficient abrasion resistance, density fluctuation caused by an offset during fixation, and roughening of an image. However, the inkjet recording method of the invention provides excellent offset resistance, and prevents the occurrence of density unevenness. Thus, an image in which fine lines and/or fine image portions are printed with high resolution and uniformity and which has superior abrasion resistance can be recorded.

A commercially available coated paper may be used. For example, a coated paper for general printing may be used, and specific examples thereof include coat papers (A2, B2) such as "OK TOPCOAT+" manufactured by Oji Paper Co., Ltd., "AURORACOAT" and "U-LITE" manufactured by Japan Paper Group, Inc.; and art paper (A1) such as "TOKUBISHI ART" manufactured by Mitsubishi Paper Mills, Ltd.

Each process in the inkjet recording method of the invention is described in detail below.

-Optional Treatment Liquid Applying Process-

In the optional treatment liquid applying process according to the invention, the below-described treatment liquid containing an aggregating agent capable of aggregating (hereinafter also referred to by an expression "fixing") components contained in the ink, is applied to a recording medium. When the inkjet recording method includes performing image recording using ink in the presence of such a treatment liquid, curling and cockling after recording may be suppressed, and the occurrence of ink repellence may also be suppressed, which is suitable for recording an image having excellent offset resistance and excellent abrasion resistance.

(Treatment Liquid)

The treatment liquid according to the invention contains at least one aggregating agent. The aggregating agent causes formation of aggregates when contacting with the ink described below, and may be selected, without particular limitation, from agents that cause aggregation when contacting with the ink.

The aggregating agent may be any of a compound capable of changing the pH of the ink, a polyvalent metal salt or a cationic compound. According to the invention, a compound capable of changing the pH of the ink is preferable from the viewpoint of the ink aggregation properties, and a compound that can lower the pH of the ink is more preferable.

The compound that can lower the pH of the ink may be an acidic substance.

Examples of the acidic substance include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, or derivatives of these compounds, or salts of the compounds, and the like.

The acidic substance may be used singly, or in combination of two or more thereof.

When the treatment liquid used in the invention contains an acidic substance, the pH of the treatment liquid is preferably from 0.1 to 6.0, more preferably from 0.5 to 5.0, and even more preferably from 0.8 to 4.0.

Examples of the polyvalent metal salt include a salt of any of the following: an alkaline earth metal, which belongs to Group 2 of the Periodic Table, such as magnesium or calcium; a transition metal belonging to Group 3 of the Periodic Table, such as lanthanum; a metal belonging to Group 13 of the Periodic Table, such as aluminum; and a lanthanide, such as neodymium. The salt of such a metal is preferably a carboxylic acid salt (such as a formate, acetate, or benzoate), a nitrate, a chloride, or a thiocyanate. In particular, the following salts are preferable: a calcium or magnesium salt of a carboxylic acid (such as formic acid, acetic acid, or benzoic acid); a calcium or magnesium salt of nitric acid; calcium chloride; magnesium chloride; and a calcium or magnesium salt of thiocyanic acid.

Among them, highly water-soluble acidic substances are preferable. From the viewpoint of reacting with the ink to fix the entire ink, an acidic substance having a valency of 3 or lower is preferable, and an acidic substance having a valency of 2 to 3 is particularly preferable.

Preferable examples of the cationic compound include a cationic surfactant. Preferred examples of the cationic surfactant include a compound of a primary, secondary or tertiary amine salt. Examples of such an amine salt compound include compounds such as hydrochlorides or acetates (for example, laurylamine, coconut amine, stearylamine, rosin amine), quaternary ammonium salt compounds (for example, lauryltrimethylammonium chloride, cetyltrimethylammonium chloride, lauryldimethylbenzylammonium chloride, benzyltributylammonium chloride, benzalkonium chloride), pyridinium salt compounds (for example, cetylpyridinium chloride, cetylpyridinium bromide), imidazoline cationic compounds (for example, 2-heptadecenyl-hydroxyethylimidazoline), and ethylene oxide adducts of higher alkylamines (for example, dihydroxyethylstearylamine). Examples of these amine-salt compounds also include polyallylamines. Further, amphoteric surfactants that exhibit cationic properties in a desired pH region may also be used, examples of which include amino acid amphoteric surfactants, R—NH—$CH_2CH_2$—COOH compounds, carboxylate salt amphoteric surfactants (for example, stearyldimethylbetaine, lauryldihydroxyethylbetaine), and amphoteric surfactants of a sulfuric ester, sulfonic acid or a phosphoric ester.

The aggregating agent may be used singly or in a mixture of two or more thereof.

The content of the aggregating agent, which is capable of aggregating the ink, in the treatment liquid is preferably from 1% by mass to 50% by mass, more preferably from 3% by mass to 45% by mass, even more preferably from 5% by mass to 40% by mass, relative to the treatment liquid.

The acidic substance may be used singly or in a mixture of two or more thereof. The cationic compound may be used singly or in a mixture of two or more thereof.

When at least one of the acidic substance or the cationic compound is used in combination with the polyvalent metal compound, the content of the acidic substance and the cationic compound in the treatment liquid (the total content of the acidic substance and the cationic compound) is preferably from 5% by mass to 95% by mass, and more preferably from 20% by mass to 80% by mass, relative to the total content of the polyvalent metal compound.

In general, the treatment liquid according to the present invention may contain a water-soluble organic solvent in addition to the aggregating agent, and may contain various other additives. Details of the water-soluble organic solvent and the various other additives are similar to the additives that may be added to the ink described below.

In regard to the application of the treatment liquid on a recording medium, known liquid application methods may be used without any particular limitation, and any method may be selected. Examples of the method include spray coating, coating using a coating roller, application by an inkjet method, and immersion.

Specific examples of a treatment liquid application method include size press methods represented by a horizontal size press method, a roll coater method, a calender size press method or the like; size press methods represented by an air knife coater method or the like; knife coater methods represented by an air knife coater method or the like; roll coater methods represented by a transfer roll coater method such as a gate roll coater method, a direct roll coater method, a reverse roll coater method, a squeeze roll coater method or the like; blade coater methods represented by a billblade coater method, a short dwell coater method, a two stream coater method or the like; bar coater methods represented by a rod bar coater method; cast coater methods; gravure coater methods; curtain coater methods; die coater methods; brush coater methods; and transfer methods.

A method of coating while regulating the coating amount by using a coating apparatus equipped with a liquid amount controlling member may be used, as in the case of the coating apparatus described in JP-A No. 10-230201.

Regarding the region to be applied with the treatment liquid, a whole-surface application may be performed in which the treatment liquid is applied over an entire one surface of the recording medium (for example, coated paper), or a partial application may be performed in which the treatment liquid is selectively applied to a region at which inkjet recording is to be performed in the subsequent image recording process. The above application of the treatment liquid may be performed on one surface of the recording medium or on both surfaces of the recording medium. According to the invention, a whole-surface application of the treatment liquid in which the treatment liquid is applied over an entire one surface of the recording medium using a coating roller or the like is preferable in view of adjusting the application amount of the treatment liquid to be uniform, achieving recording of uniform fine lines, uniform fine image portions or the like, and suppressing image unevenness such as density unevenness.

The method of coating while adjusting the application amount of the aggregating agent to the range described above may be, for example, a method using an Anilox roller. The Anilox roller is a roller having depressed portions in a certain shape such as a pyramidal form, an oblique line form, or a testudinal form, which are formed by laser-processing the roller surface that has been thermally sprayed with a ceramic. The treatment liquid enters the depressed portions provided on the roller surface, and is transferred to paper when coming into contact with a surface of the paper, whereby the treatment liquid is applied in an application amount that is adjusted by the depressed portions on the Anilox roller.

The surface tension (25° C.) of the treatment liquid is preferably from 20 mN/m to 60 mN/m, more preferably from 25 mN/m to 50 mN/m, and even more preferably from 25 mN/m to 45 mN/m.

The surface tension of the treatment liquid is measured under the conditions of a temperature of 25° C. using an automatic surface tensiometer (model name: CBVP-Z, manufactured by Kyowa Interface Science Co., Ltd.).

In the present invention, the viscosity of the treatment liquid is measured under the conditions of a temperature of 25° C. using a viscometer (model name: TV-22, manufactured by Toki Sangyo Co., Ltd.).

-First Treatment Process-

According to the invention, it is preferable to perform at least one process (first treatment process) selected from a drying treatment or a penetration treatment, after applying the treatment liquid to a recording medium (preferably, a coated paper) as described above. By providing this first treatment process, the tackiness of the image region measured by the ball tack test method can be adjusted to 20 mm or greater (preferably, within 7 seconds of the completion of image formation). The treatment process may include either of the drying treatment or the penetration treatment, or may include both the drying treatment and the penetration treatment.

The drying treatment may be, for example, a treatment of drying and removing (removing by drying) the solvent contained in the treatment liquid, after the application of the treatment liquid. When the solvent in the treatment liquid is removed by drying after the treatment liquid is applied onto the recording medium, the occurrence of curling, cockling or ink repellence may be suppressed more effectively, the offset resistance and the abrasion resistance of the recorded image may be further enhanced, and image recording may be performed more favorably.

The drying treatment is not particularly limited, as long as at least a part of the solvent (for example, water or a water-soluble organic solvent) contained in the treatment liquid is removed. The removal by drying may be performed by, for example, a method of drying by at least one of heating, air blowing (for example, blowing dry air), or the like.

The drying treatment may be performed by changing the conveyance speed of the recording medium after completion of the application of the treatment liquid. Specifically, the conveyance speed during the drying treatment is not particularly limited so long as the conveyance speed is in a range at which at least a portion of the solvent (for example, water or water-soluble organic solvent) contained in the treatment liquid can be removed, and the conveyance speed during the drying treatment is preferably from 100 to 3000 mm/s, more preferably from 150 to 2700 mm/s, and even more preferably from 250 to 2500 mm/s.

Examples of the penetration treatment include a method of allowing the recording medium applied with the treatment liquid to stand for a predetermined time so as to allow the treatment liquid to penetrate into the recording medium by natural penetration due to the capillary phenomenon; a method of suctioning, by reduced pressure, the treatment liquid from a surface of the recording medium that is opposite to the surface applied with the treatment liquid; and a method of providing a vapor pressure difference to a surface of the recording medium that is opposite to the front surface.

The time for which the recording medium applied with the treatment liquid is allowed to stand may depend on the amount of the applied treatment liquid and/or the area of the surface of the recording medium to which the treatment liquid is applied. The recording medium may be allowed to stand for 0.01 seconds to 2 second from application of the treatment liquid if the treatment liquid is applied to a surface having an area of 1 $m^2$.

-Image Recording Process-

In the image recording process, an image is recorded by applying an ink which contains at least a pigment onto a recording medium by an inkjet method. The ink preferably has a composition that includes resin particles, a water-soluble organic solvent and water, as well as the pigment. The details of the ink are described below.

In the image recording according to the inkjet method, the ink is jetted, by application of energy, to the recording medium (preferably, coated paper) to which the treatment liquid has been applied, such that the spotted ink contacts the treatment liquid, whereby a color image is formed. An inkjet recording method that is preferably used in the invention is the method described in paragraphs [0093] to [0105] of JP-A No. 2003-306623.

The inkjet method is not particularly limited and may be any known method such as a charge-control method in which an ink is ejected by electrostatic attraction force, a drop-on-demand method (pressure pulse method) in which an oscillation pressure of a piezo element is utilized, an acoustic inkjet method in which ink is ejected by a radiation pressure generated by irradiating the ink with acoustic beams that have been converted from electric signals, and a thermal inkjet method in which an ink is jetted by a pressure generated by formation of bubbles caused by heating of the ink (BUBBLEJET (registered trade mark)). As the inkjet method, an inkjet method described in JP-A No. 54-59936 can be suitably used; in this method, an ink is jetted from a nozzle by an acting force generated by rapid change in volume of the ink caused by application of thermal energy.

Examples of the inkjet method include a method in which a large number of small-volume droplets of an ink having a low optical density (photo-ink) are jetted, a method in which plural inks having substantially the same hue at different optical densities are used to improve image quality, and a method in which a colorless transparent ink is used.

The inkjet head used in the inkjet method may be either an on-demand system or a continuous system. Specific examples of jetting systems include an electric-mechanical transduction system (for example, a single-cavity system, a double-cavity system, a bender system, a piston system, a share-mode system, and a shared-wall system), an electric-thermal transduction system (for example, a thermal inkjet system and the BUBBLEJET (registered trade mark) system), an electrostatic suction system (for example, an electric field control system and a slit jet system), and an electric discharge system (for example, a spark jet system). The jetting system to be employed may be any jetting system.

Ink nozzles and the like used for recording by the inkjet method are not particularly limited, and may be selected properly depending on the purpose.

The conveyance speed of the recording medium during the image recording process is not particularly limited so long as the conveyance speed is within a range in which the image quality is not impaired, and the conveyance speed is preferably from 100 to 3000 mm/s, more preferably from 150 to 2700 mm/s, and even more preferably from 250 to 2500 mm/s.

-Second Treatment Process-

According to the invention, it is preferable to provide a second treatment process in which a treatment, such as regulating the temperature of the image region and/or drying the image region, is performed in order to adjust the tackiness of the image region measured by the ball tack test method to be 20 mm or greater (preferably within 7 seconds from the completion of the image formation).

The drying treatment of the image region may be performed by changing the conveyance speed of the recording medium, after the application of ink in the image recording process is completed. The conveyance speed during the drying treatment is not particularly limited so long as the conveyance speed is in a range at which at least a portion of the solvent (for example, water or water-soluble organic solvent) contained in the image region can be removed, and the conveyance speed during the drying treatment is preferably from 100 to 3000 mm/s, more preferably from 150 to 2700 mm/s, and even more preferably from 250 to 2500 mm/s.

The drying treatment of the image region may also be performed by a treatment of changing and regulating the temperature of the image region. The temperature of the image region is not particularly limited so long as the temperature is in a range at which at least a portion of the solvent contained in the image region can be removed, and the surface temperature of the image region is preferably 20° C. or higher, more preferably 30° C. or higher, and even more preferably 40° C. or higher. The upper limit is preferably 200° C.

Among them, the temperature of the image region is preferably regulated such that the surface temperature of the image region is in the range of from 30° C. to 180° C., more preferably in the range of from 35° C. to 150° C., and even more preferably in the range of from 40° C. to 120° C.

The drying treatment may be performed as described in the first treatment process above. The drying method is not particularly limited so long as at least a portion of the water or solvent in the ink can be removed by drying. Specifically, the treatment may be performed using a general method such as heating the image region and/or blowing air (supplying dry air) against the image region.

This drying treatment is more preferably performed after the image recording process, from the viewpoints of suppressing occurrence of curling or cockling and improving the offset resistance and/or abrasion resistance of the image.

-Fixing Process-

In the fixing process, the image region is fixed by pressure-contacting a pressure-bonding member to the image region when the tackiness, as measured by the ball tack test method, of the image region recorded in the image recording process becomes 20 mm or greater.

The fixation of image may be performed by pressure-contacting a pressure-bonding member to the ink that is provided on the recording medium and that forms the image region. According to the invention, the tackiness of the image region measured by the ball tack test method is adjusted, in advance, to 20 mm or greater prior to the fixing process, as described above. As a result, the offset phenomenon whereby the image is impaired by transfer of the image (ink) to the pressure-bonding member when the image contacts the pressure-bonding member, is prevented, and thus image fixation can be performed rapidly while the image quality is maintained. Thereby, an image having excellent texture such as image glossiness, high abrasion resistance (for example, adhesiveness to paper), and excellent image quality is recorded at high speed.

The fixation of the image region may be performed by conducting a pressurization process after the image recording process. In the pressurization process, for example, at least a pressure application unit that applies pressure to the image is used, and fixation (fixing treatment) is performed by pressurizing the image region by pressure-contacting the pressure application unit to the image region. Alternatively, a heat-pressure-boning process may be conducted in which fixation (fixing treatment) is performed by bonding the image region by heat and pressure using, in combination with the pressure application unit, a heating unit that heats the image region. Examples of the pressure application unit include a pressurization plate and a pair of rolls that are in pressure contact with each other, and examples of the heating unit include a heating roll and a heating plate.

Specifically, a treatment of pressure-bonding the image to the surface of the recording medium using, for example, a heated heating roll or heating plate may be performed after the image recording process, for example. In this treatment, the resin particles contained in the ink can be melted. During the treatment, the heating temperature is preferably higher than the glass transition temperature Tg of the resin particles contained in the ink.

(Ink)

In the following, the ink according to the invention is described in detail.

The ink according to the invention (hereinafter, simply referred to as "ink") contains at least one pigment, and preferably contains the at least one pigment, at least one resin particle, and at least one water-soluble organic solvent. The ink may also contain other components such as surfactants, if necessary.

The ink may be used in the formation of monochromatic images as well as in the formation of multi-color images (for example, full color images), and desired color or colors, (i.e., one color or two or more colors) may be selected for image recording. When forming a full color image, the inks to be used may be a magenta color tone ink, a cyan color tone ink, and a yellow color tone ink Furthermore, a black color tone ink may be used additionally in order to adjust the color tone.

The inks to be used may include one or more inks that have other color tones than the yellow (Y), magenta (M) and cyan (C) color tones, such as at least one of a red (R) color tone ink, a green (G) color tone ink, a blue (B) color tone ink or a white (W) color tone ink, and may include an ink of a special color used in the printing field.

The aforementioned inks of the respective color tones may each be prepared by replacement by a colorant (for example, a pigment) having the desired color hue.

The solid concentration of the ink is not particularly limited. The concentration of solid content is preferably 5% by mass or more, more preferably 8% by mass or more, even more preferably 10% by mass or more, and particularly preferably 12% by mass or more, from the viewpoint of achieving a good balance between the respective properties and simultaneously achieving the required properties such as offset resistance and abrasion resistance, particularly from the viewpoint of adjusting the tackiness of the image region measured by the ball tack test method to 20 mm or greater. The upper limit is preferably 35% by mass.

In particular, the solid concentration of the ink is preferably from 5 to 35% by mass, more preferably from 8 to 30% by mass, even more preferably from 10 to 25% by mass, and particularly preferably from 12 to 23% by mass.

<Pigment>

The pigment is not particularly limited, and may be appropriately selected in accordance with the purpose. For example, the pigment may be either an organic pigment or an inorganic pigment.

Examples of the organic pigment include azo pigments, polycyclic pigments, dye chelates, nitro pigments, nitroso pigments, and aniline black. Among these, azo pigments and polycyclic pigments are more preferred. Examples of the azo pigments include azo lakes, insoluble azo pigments, condensed azo pigments, and chelate azo pigments. Examples of the polycyclic pigment include phthalocyanine pigments, perylene pigments, perinone pigments, anthraquinone pigments, quinacridone pigments, dioxazine pigments, indigo pigments, thioindigo pigments, isoindolinone pigments, and quinophthalone pigments. Examples of the dye chelates include basic-dye chelates and acidic-dye chelates. Examples of the inorganic pigment include titanium oxide, iron oxide, calcium carbonate, barium sulfate, aluminum hydroxide, barium yellow, cadmium red, chrome yellow, and carbon black. Among these, carbon black is particularly preferable.

Examples of carbon black include products produced according to known methods such as a contact method, a furnace method, and a thermal method. Among these pigments, water-dispersible pigments are preferable.

Specific examples of the water-dispersible pigments include the following pigments (1) to (4).

(1) An encapsulated pigment, which is a polymer dispersion in which a pigment is contained in polymer fine particles. More specifically, the encapsulated pigment is a pigment that is coated with a hydrophilic and water-insoluble resin and that is dispersible in water due to the presence of the resin layer on the surface of the pigment, the resin layer imparting hydrophilicity to the pigment.

(2) A self-dispersing pigment, which is a pigment having at least one hydrophilic group at the surface thereof and exhibiting at least either of water-solubility or water-dispersibility in the absence of a dispersant. More specifically, the self-dispersing pigment is a pigment that is produced by hydrophilizing a pigment (typically, carbon black) through surface oxidation and that is dispersible in water by itself.

(3) A resin-dispersed pigment, which is a pigment dispersed in a water-soluble polymer compound having a weight average molecular weight of 50,000 or less.

(4) A surfactant-dispersed pigment, which is a pigment dispersed using a surfactant.

Among these, the (1) encapsulated pigment and the (2) self-dispersing pigment are preferable, and the (1) encapsulated pigment is particularly preferable.

In the following, the (1) encapsulated pigment is described in detail.

The resin for the encapsulated pigment is not limited, and is preferably a polymer compound having an anionic group (acidic) and having self-dispersibility or solubility in a mixed solvent of water and a water-soluble organic solvent. Usually, the resin preferably has a number average molecular weight in the range of from about 1,000 to about 100,000, and particularly preferably in the range of from about 3,000 to about 50,000. The resin preferably dissolves in an organic solvent to form a solution. When the number average molecular weight of the resin is within the above range, the resin of the encapsulated pigment exhibits functions as a coating layer of the pigment and/or as a coating layer when used in an ink The resin is preferably used in the form of a salt of an alkali metal or a salt of an organic amine.

Specific examples of the resin for the encapsulated pigment include materials having an anionic group, such as thermoplastic, thermosetting or modified acrylic, epoxy, polyurethane, polyether, polyamide, unsaturated polyester, phenolic, silicone or fluorine resins; polyvinyl resins such as polyvinyl chloride, polyvinyl acetate, polyvinyl alcohol or polyvinyl butyral; polyester resins such as alkyd resins and phthalic acid resins; amino materials such as melamine resins, melamine-formaldehyde resins, aminoalkyd co-condensed resins, urea resins, and urea-formaldehyde resins; or copolymers or mixtures thereof.

The anionic acrylic resins may be obtained by, for example, polymerizing, in a solvent, an acrylic monomer having an anionic group (hereinafter, referred to as "anionic group-containing acrylic monomer") and one or more optional monomers capable of copolymerizing with the anionic group-containing acrylic monomer. Examples of the anionic group-containing acrylic monomer include acrylic monomers having one or more anionic groups each selected from the group consisting of a carboxyl group, a sulfonic group and a phosphonic group. Among them, acrylic monomers having a carboxyl group are particularly preferable.

Specific examples of acrylic monomers having a carboxyl group include acrylic acid, methacrylic acid, crotonic acid, ethacrylic acid, propylacrylic acid, isopropylacrylic acid, itaconic acid, and fumaric acid. Among these, acrylic acid or methacrylic acid is preferable.

The encapsulated pigment may be produced by a conventional physical or chemical method, using the above-described components. For example, the encapsulated pigment may be produced by the methods described in JP-A Nos. 9-151342, 10-140065, 11-209672, 11-172180, 10-25440 or 11-43636.

Specific examples of the production method include a phase-inversion-emulsification method and a acid-precipitation method such as those described in JP-A Nos. 9-151342 and 10-140065. Among them, the phase-inversion-emulsification method is preferable in view of dispersion stability. The phase-inversion-emulsification method is described below.

The aforementioned self-dispersing pigment is also a preferable example of the pigment to be used. The self-dispersing pigment is a pigment which has a large number of hydrophilic functional groups and/or salts thereof (hereinafter, referred to as "dispersibility-imparting group" or "dispersibility-imparting groups") bonded to the pigment surface directly or indirectly via an alkyl group, an alkyl ether group, an aryl group or the like, and which is dispersible in an aqueous medium without using a dispersant for pigment dispersion. Here, the term "dispersible in an aqueous medium without using a dispersant" means that the pigment can be dispersed in an aqueous medium even when a dispersant for dispersing the pigment is not used.

An ink containing a self-dispersing pigment as a colorant does not need to include a dispersant, which is usually incorporated to disperse a pigment. Therefore, it is possible to easily prepare an ink with excellent jetting stability in which foaming due to decrease in the defoaming property caused by the dispersant (that is, foaming associated with the use of the dispersant) scarcely occurs. Examples of the dispersibility-imparting group that is bonded to the surface of the self-dispersing pigment include —COOH, —CO, —OH, $—SO_3H$, $—PO_3H_2$ and quaternary ammonium, and salts thereof. The dispersibility-imparting group may be bonded to the surface of the pigment as follows. Specifically, the dispersibility-imparting group or an active species having a dispersibility-imparting group may be bonded (grafted) to the pigment surface by applying a physical treatment or a chemical treatment to the pigment. The physical treatment may be, for example, a vacuum-plasma treatment. Examples of the chemical treatment include a wet-oxidation method including oxidizing the pigment surface in water by an oxidizing agent and a method including bonding a carboxyl group to the pigment surface via a phenyl group by bonding p-aminobenzoic acid to the pigment surface.

In the invention, a preferable example of the self-dispersing pigment is a self-dispersing pigment that has been surface-treated by an oxidation treatment using hypohalous acid and/or hypohalite or by an oxidation treatment using ozone.

The self-dispersing pigment to be used may be a commercially available product, and examples of the commercially available self-dispersing pigment include MICROJET CW-1 (trade name; manufactured by Orient Chemical Industries, Ltd.) and CAB-O-JET200 and CAB-O-JET300 (trade name; manufactured by Cabot Corp.).

In the following, the phase-inversion-emulsification method is described.

The phase-inversion-emulsification method is basically a self-dispersing (phase-inversion-emulsification) method in which a uniform mixture of a pigment and a resin having self-dispersibility or solubility is dispersed in water. This uniform mixture may further include a curing agent or the polymer compound. Here, the uniform mixture may be in a state in which ingredients are mixed but are not mutually dissolved, a state in which ingredients are mutually dissolved and mixed, or a state that is a combination of these two states. Specific examples of a production method using the "phase inversion emulsification method" include the method described in JP-A No. 10-140065.

In regard to more specific methods of the phase inversion emulsification method and the acid precipitation method, the descriptions of JP-A Nos. 9-151342 and 10-140065 may be referenced.

The pigments described above may be used singly, or plural pigments selected from the above pigments may be used. Regarding the pigment classes described above, when plural pigments are used, the plural pigments may belong to the same class or may belong to different classes.

The content of pigment in the ink is preferably from 1 to 25% by mass, and more preferably from 5 to 20% by mass, relative to the total mass of the ink, from the viewpoints of color density, granularity, ink stability and jetting reliability.

<Dispersant>

When a water-dispersible pigment selected from the encapsulated pigment or the resin-dispersed pigment is used, at least one dispersant may be used therewith. Examples of the dispersant include a nonionic compound, an anionic compound, a cationic compound, an amphoteric compound.

For example, the dispersant may be a copolymer of monomers having an α,β-ethylenic unsaturated group. Examples of the monomer having an α,β-ethylenic unsaturated group include ethylene, propylene, butene, pentene, hexene, vinyl acetate, allyl acetate, acrylic acid, methacrylic acid, crotonic acid, a crotonic ester, itaconic acid, an itaconic monoester, maleic acid, a maleic monoester, a maleic diester, fumaric acid, a fumaric monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethylene glycol dimethacrylate, styrene, styrene derivatives such as α-methylstyrene and vinyltoluene, vinylcyclohexane, vinylnaphthalene, vinylnaphthalene derivatives, alkyl acrylates which may have an aromatic group as a substituent, phenyl acrylate, alkyl methacrylates which may have an aromatic group as a substituent, phenyl methacrylates, cycloalkyl methacrylates, alkyl crotonates, dialkyl itaconates, dialkyl maleates, vinyl alcohol, and derivatives of the aforementioned compounds.

One monomer having an α,β-ethylenic unsaturated group (such as those described above), or two or more monomers having an α,β-ethylenic unsaturated group, may be copolymerized, and the resultant copolymer may be used as a polymeric dispersant. Specific examples of the copolymer include alkyl acrylate-acrylic acid copolymers, alkyl methacrylate-methacrylic acid copolymers, styrene-alkyl acrylate-acrylic acid copolymers, styrene-phenyl methacrylate-methacrylic acid copolymers, styrene-cyclohexyl methacrylate-methacrylic acid copolymers, styrene-styrenesulfonic acid copolymers, styrene-maleic acid copolymers, styrene-methacrylic acid copolymers, styrene-acrylic acid copolymers, vinylnaphthalene-maleic acid copolymers, vinylnaphthalene-methacrylic acid copolymers, vinylnaphthalene-acrylic acid copolymers, polystyrene, polyester, and polyvinyl alcohol.

The dispersant preferably has a weight average molecular weight of from 2,000 to 60,000.

The addition amount of the dispersant with respect to the pigment is, on a mass basis, preferably in the range of from 10% to 100% of the amount of the pigment, more preferably from 20% to 70% of the amount of the pigment, and even more preferably from 40% to 50% of the amount of the pigment.

<Water-Soluble Organic Solvent>

The ink composition according to the present invention may contain at least one water-soluble organic solvent. Inclusion of the water-soluble organic solvent creates effects such as drying prevention, moistening, or acceleration of penetration. With respect to drying prevention, the water-soluble organic solvent is used as an anti-drying agent that prevents ejection nozzle clogging due to aggregation of ink that has attached and dried at an ink ejection port of a jetting nozzle. For drying prevention or moistening, a water-soluble organic solvent having a lower vapor pressure than that of water is preferable. With respect to the acceleration of penetration, the water-soluble organic solvent may be used as a penetration promoter which enhances the penetrability of the ink into paper.

Examples of the water-soluble organic solvent include alkanediols (, which are polyhydric alcohols), such as glycerin, 1,2,6-hexanetriol, trimethylolpropane, ethylene glycol, and propylene glycol; saccharides such as glucose, mannose, and fructose; sugar alcohols; hyaluronic acids; alkyl alcohols having 1 to 4 carbon atoms, such as ethanol, methanol, butanol, propanol, and isopropanol; and glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-isopropyl ether, diethylene glycol mono-isopropyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-isopropyl ether, dipropylene glycol monomethyl ether, dipropylene glycol monoethyl ether, dipropylene glycol mono-n-propyl ether, and dipropylene glycol mono-isopropyl ether. The water-soluble organic solvent may be used singly, or in combination of two or more thereof.

For the purpose of drying prevention or moistening, polyhydric alcohols are useful, and examples thereof include glycerin, ethylene glycol, diethylene glycol, triethylene glycol, propylene glycol, dipropylene glycol, tripropylene glycol, 1,3-butanediol, and 2,3-butanediol. These may be used singly, or in combination of two or more thereof.

For the purpose of accelerating penetration, polyol compounds are preferred, and aliphatic diols are suitable. Examples of the aliphatic diols include 2-ethyl-2-methyl-1,3-propanediol, 3,3-dimethyl-1,2-butanediol, 2,2-diethyl-1,3-propanediol, 2-ethyl-1,3-hexanediol, and 2,2,4-trimethyl-1,3-pentanediol. Among these, 2-ethyl-1,3-hexanediol and 2,2,4-trimethyl-1,3-pentanediol are preferable.

Furthermore, the ink preferably contains at least one compound represented by the following Structural Formula (1) as a water-soluble organic solvent, from the viewpoint of suppressing the occurrence of curling of the recording medium.

Structural Formula (1)

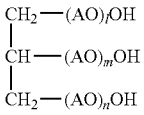

In Structural Formula (1), l, m and n each independently represent an integer of 1 or larger, and the value of l+m+n is from 3 to 15. The value of l+m+n is preferably in the range of from 3 to 12, and more preferably in the range of from 3 to 10. When the value of l+m+n is 3 or larger, curling can be suppressed well, and when the value is 15 or less, good ejectability may be obtained. In Structural Formula (1), each AO independently represents ethyleneoxy (EO) or propyleneoxy (PO), preferably a propyleneoxy group. In an embodiment, l represents 1, or l represents an integer of 2 or more and plural AOs in $(AO)_l$ are the same as each other; m represents 1, or m represents an integer of 2 or more and plural AOs in $(AO)_m$ are the same as each other; and n represents 1, or n represents an integer of 2 or more and plural AOs in $(AO)_n$ are the same as each other. In this particular embodiment, the AO in $(AO)_l$ may be the same as or different from the AO in $(AO)_m$; the AO in $(AO)_l$ may be the same as or different from the AO in $(AO)_n$; and the AO in $(AO)_m$ may be the same as or different from the AO in $(AO)_n$.

Examples of the compound represented by Structural Formula (1) are shown below, together with their SP values (listed in parentheses). However, the invention is not intended to be limited to these. Here, the SP value (solubility parameter) is a value represented by the square root of molecular cohesive energy, and is calculated by the method described in R. F. Fedors, Polymer Engineering Science, 14, pp. 147 to 154 (1974), which is incorporated herein by reference.

POP(3) GLYCERYL ETHER (SP VALUE 26.4)

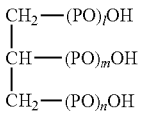

l + m + n = 3

POP(4) GLYCERYL ETHER (SP VALUE 24.9)

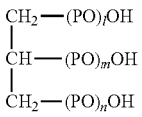

l + m + n = 4

POP(5) GLYCERYL ETHER (SP VALUE 23.9)

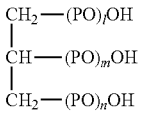

l + m + n = 5

-continued

POP(6) GLYCERYL ETHER (SP VALUE 23.2)

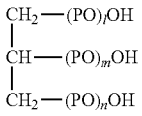

l + m + n = 6

POP(7) GLYCERYL ETHER (SP VALUE 22.6)

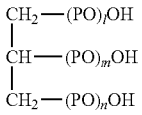

l + m + n = 7

$nC_4H_9O(AO)_4$—H (AO=EO or PO, the ratio is EO:PO=1:1)

$nC_4H_9O(AO)_{10}$—H (AO=EO or PO, the ratio is EO:PO=1:1)

$HO(A'O)_{40}$—H (A'O=EO or PO, the ratio is EO:PO=1:3)

$HO(A''O)_{55}$—H (A"O=EO or PO, the ratio is EO:PO=5:6)

$HO(PO)_3$—H $HO(PO)_7$—H 1,2-Hexanediol

In the invention, EO and PO represent an ethyleneoxy group and a propyleneoxy group, respectively.

The content ratio of the compound represented by Structural Formula (1) in the total amount of water-soluble organic solvent is preferably 10% by mass or more, more preferably 30% by mass or more, and even more preferably 50% by mass or more. When the content ratio is set in the range described above, curling can be suppressed without deteriorating the stability or ejectability of the ink, which is preferable.

The water-soluble organic solvent may be used singly, or as a mixture of two or more thereof.

The content of water-soluble organic solvent in the ink is preferably from 1% by mass to 60% by mass, and more preferably from 5% by mass to 40% by mass, with respect to the total amount of the ink.

<Water>

The ink according to the present invention may contain water, and the amount of water is not particularly limited. The amount of water is preferably from 10% by mass to 99% by mass, more preferably from 30% by mass to 80% by mass, and even more preferably from 50% by mass to 70% by mass, with respect to the total amount of the ink.

<Resin Particle>

The ink according to the invention preferably contains at least one kind of resin particles. Inclusion of resin particles in the ink may improve mainly the fixability of the ink to a recording medium, and offset resistance and abrasion resistance of the image. The resin particles have a function of fixing the ink (i.e., fixing the image) by thickening the ink through aggregation or dispersion destabilization of the resin particles when the ink contacts with the treatment liquid or with paper to which the aggregating agent has been applied by applying and drying the treatment liquid.

Examples of the resin particles include particles of any of the following resins: (meth)acrylic resins, vinyl acetate resins, styrene-butadiene resins, vinyl chloride resins, acrylstyrene resins, butadiene resins, styrenic resins, crosslinked acrylic resins, crosslinked styrenic resins, benzoguanamine resins, phenolic reins, silicone resins, epoxy resins, urethane resins, paraffin resins, fluororesins. Various kinds of resin fine particles may be used, such as (meth)acrylic resins, acrylic-styrene resins, styrenic resins, crosslinked acrylic resins, and crosslinked styrenic resins. In particular, (meth)acrylic resin particles are preferred.

A (meth)acrylic resin may be obtained by polymerizing, for example, a (meth)acrylic monomer having an anionic group (an anionic group-containing (meth)acrylic monomer) and, optionally, one or more other monomers which can copolymerize with the anionic group-containing (meth)acrylic monomer. Examples of the anionic group-containing (meth) acrylic monomer include a (meth)acrylic monomer having at least one selected from the group consisting of a carboxyl group, a sulfonic group and a phosphonic group. Among them, a (meth)acrylic monomer having a carboxyl group (for example, acrylic acid, methacrylic acid, crotonic acid, ethacrylic acid, propylacrylic acid, isopropylacrylic acid, itaconic acid, or fumaric acid) is preferable, and acrylic acid or methacrylic acid is particularly preferable.

The resin particles may be in the form of a latex in which the resin particles are dispersed in water and/or organic solvent. Various latexes are suitable such as (meth)acrylic latexes, vinyl acetate latexes, styrenic latexes and polyester latexes. In particular, (meth)acrylic latexes are preferable.

The resin particles according to the invention are preferably self-dispersing polymer particles, and more preferably self-dispersing polymer particles having a carboxyl group, from the viewpoints of the jetting stability and the dispersion stability of the pigment.

Among them, the self-dispersing polymer is preferably a polymer that includes hydrophilic structural units and hydrophobic structural units including at least one kind of structure derived from at least one alicyclic (meth)acrylate. An ink with which an image having excellent fixability and blocking resistance can be obtained may be provided by including a structure derived from an alicyclic (meth)acrylate. When the ink is applied to inkjet recording, satisfactory ejectability can be exhibited. The expression " . . . structural unit . . . derived from . . . (A)" used herein means a component in a polymer which component is formed by the binding of (A) to an adjacent structural unit or units.

The self-dispersing polymer according to the invention is a water-insoluble polymer that can get into a dispersed state in an aqueous medium due to a functional group (particularly an acidic group or a salt thereof) of the polymer itself when the polymer is dispersed by a reverse phase emulsification method in the absence of surfactant.

The scope of the term, "dispersed state", used herein includes an emulsified state (emulsion) in which a water-insoluble polymer in the liquid state is dispersed in an aqueous medium and a dispersed state (suspension) in which a water-insoluble polymer in the solid state is dispersed in an aqueous medium.

The self-dispersing polymer according to the invention is preferably a self-dispersing polymer that can get into a dispersed state in which the water-insoluble polymer is dispersed in the solid state, from the viewpoint of fixability of an ink containing the self-dispersing polymer.

The method for preparing an emulsified or dispersed state of a self-dispersing polymer (i.e., the method for preparing an aqueous dispersion of a self-dispersing polymer) may be a reverse phase emulsification method. An example of the reverse phase emulsification method is a method including dissolving or dispersing a self-dispersing polymer in a solvent (for example, a water-soluble organic solvent), subsequently introducing the resulting solution or dispersion directly into water without adding any surfactant, stirring and mixing the mixture liquid in the state in which the salt-forming groups (for example, acidic groups) of the self-dispersing polymer are neutralized, and removing the solvent, as a result of which an aqueous dispersion in which the self-dispersing polymer is emulsified or dispersed is obtained.

The following procedure can be used to determine whether a water-insoluble polymer is a self-dispersing polymer as mentioned herein: 30 g of a water-insoluble polymer is dissolved in 70 g of an organic solvent (such as methyl ethyl ketone) to form a solution, the solution is mixed with 200 g of water and a neutralizing agent that can neutralize the salt-forming groups of the water-insoluble polymer to a degree of 100% (the neutralizing agent being sodium hydroxide if the salt-forming groups are anionic, or acetic acid if the salt-forming groups are cationic), the mixture is stirred with a stirrer having a stirring blade at a rotation rate of 200 rpm at 25° C. for 30 minutes, and the organic solvent is removed from the mixture liquid. If precipitation is not observed visually and a stable dispersion or emulsion state of the water-insoluble polymer in the mixture liquid lasts for at least one week at 25° C. after the removal of the organic solvent, the water-insoluble polymer is considered to be a self-dispersing polymer.

The stability of the emulsified or dispersed state of the self-dispersing polymer can also be confirmed by a sedimentation acceleration test involving centrifugation. The stability according to the sedimentation acceleration test involving centrifugation can be evaluated by, for example, adjusting an aqueous dispersion of the polymer particles obtained by the above method to have a solid concentration of 25% by mass, subsequently centrifuging the dispersion at 12000 rpm for one hour, and measuring the solid concentration of the supernatant after the centrifuging.

A high ratio of the solid concentration after the centrifuging to the solid concentration before the centrifuging (i.e., a ratio close to 1) suggests that sedimentation of the polymer particles due to the centrifuging does not occur, i.e., the aqueous dispersion of the polymer particles is more stable. According to the invention, the ratio of the solid concentration after the centrifuging to the solid concentration before the centrifuging is preferably 0.8 or higher, more preferably 0.9 or higher, and particularly preferably 0.95 or higher.

Further, the term "water-insoluble polymer" used herein refers to a polymer that shows a solubility of 10 g or less when the polymer is dried at 105° C. for 2 hours and then dissolved in 100 g of water at 25° C. The solubility is preferably 5 g or less, and more preferably 1 g or less. The solubility described above is a value measured after the polymer is 100% neutralized with either sodium hydroxide or acetic acid depending on the kind of the salt-forming groups of the water-insoluble polymer.

In the self-dispersing polymer according to the invention, the content of water-soluble component exhibiting water-solubility when the self-dispersing polymer is dispersed is preferably 10% by mass or less, more preferably 8% by mass or less, and even more preferably 6% by mass or less. When the water-soluble component is contained at a concentration of 10% by mass or less, swelling of the polymer particles or fusion of the polymer particles can be effectively suppressed, and thus a more stable dispersed state can be maintained. Further, the increase in the ink viscosity can also be suppressed, and for example, when the ink is applied to an inkjet method, jetting stability is further improved.

Here, the water-soluble component described above is a structural unit that is contained in the self-dispersing polymer and that contributes to water solubility of the self-dispersing polymer when the self-dispersing polymer is brought into a dispersed state. The water-soluble component may be a water-soluble structural unit which is generated as a by-product or is incorporated into the self-dispersing polymer during the process of producing the self-dispersing polymer.

(Hydrophobic Structural Unit)

It is preferable that the self-dispersing polymer according to the invention contain at least one structure derived from an alicyclic (meth)acrylate as a hydrophobic structural unit. The main chain skeleton of the polymer contained in the self-dispersing polymer particles is not particularly limited, and the self-dispersing polymer is preferably a vinyl polymer from the viewpoint of the dispersion stability of the polymer particles.

-Alicyclic (Meth)Acrylate-

The alicyclic (meth)acrylate has a structure which includes a structural portion derived from (meth)acrylic acid and a structural portion derived from alcohol, and the structural portion derived from alcohol contains at least one unsubstituted or substituted alicyclic hydrocarbon group. Furthermore, the alicyclic hydrocarbon group may constitute the structural portion derived from alcohol itself, or may be linked to the structural portion derived from alcohol via a linking group.

The term, "(meth)acrylic acid", means methacrylic acid or acrylic acid or both, and the term, "(meth)acrylate", means methacrylate or acrylate or both.

The alicyclic hydrocarbon group is not particularly limited so long as it contains a non-aromatic cyclic hydrocarbon group, and examples thereof include a monocyclic hydrocarbon group, a bicyclic hydrocarbon group, and a polycyclic hydrocarbon group having three or more rings.

Examples of the alicyclic hydrocarbon group include a cycloalkyl group such as a cyclopentyl group or a cyclohexyl group, a cycloalkenyl group, a bicyclohexyl group, a norbornyl group, an isobornyl group, a dicyclopentanyl group, a dicyclopentenyl group, an adamantyl group, a decahydronaphthalenyl group, a perhydrofluorenyl group, a tricyclo[5.2.1.$0^{2,6}$]decanyl group, and a bicyclo[4.3.0]nonane.

The alicyclic hydrocarbon group may further have a substituent. Examples of the substituent include an alkyl group, an alkenyl group, an aryl group, an aralkyl group, an alkoxy group, a hydroxyl group, a primary amino group, a secondary amino group, a tertiary amino group, an alkylcarbonyl group, an arylcarbonyl group, and a cyano group.

Furthermore, the alicyclic hydrocarbon group may form a condensed ring.

It is preferable that the alicyclic hydrocarbon group according to the invention has from 5 to 20 carbon atoms in the alicyclic hydrocarbon group moiety, from the viewpoint of viscosity or solubility.

Suitable examples of the linking group that links the alicyclic hydrocarbon group and the alcohol-derived structural portion include an alkyl group, an alkenyl group, an alkylene group, an aralkyl group, an alkoxy group, a mono- or oligoethylene glycol group, and a mono- or oligo-propylene glycol group, each of which has from 1 to 20 carbon atoms.

Specific examples of the alicyclic (meth)acrylate are shown below, but the invention is not limited thereto.

Examples of monocyclic (meth)acrylates include a cycloalkyl (meth)acrylate having a cycloalkyl group having from 3 to 10 carbon atoms, such as cyclopropyl (meth)acrylate, cyclobutyl (meth)acrylate, cyclopentyl (meth)acrylate, cyclohexyl (meth)acrylate, cycloheptyl (meth)acrylate, cyclooctyl (meth)acrylate, cyclononyl (meth)acrylate and cyclodecyl (meth)acrylate. Examples of bicyclic (meth)acrylates include isobornyl (meth)acrylate and norbornyl (meth) acrylate. Examples of tricyclic (meth)acrylates include adamantyl (meth)acrylate, dicyclopentanyl (meth)acrylate, and dicyclopentenyloxyethyl (meth)acrylate.

These can be used singly, or as a mixture of two or more thereof.

Among these, from the viewpoints of the dispersion stability, fixability and blocking resistance of the self-dispersing polymer particles, the alicyclic (meth)acrylate is preferably at least one of bicyclic (meth)acrylate or tricyclic or higher polycyclic (meth)acrylate, and is more preferably at least one selected from the group consisting of isobornyl (meth)acrylate, adamantyl (meth)acrylate and dicyclopentanyl (meth) acrylate.

According to the invention, the content of structural unit derived from the alicyclic (meth)acrylate contained in the self-dispersing polymer particles is preferably from 20% by mass to 90% by mass, and more preferably from 40% by mass to 90% by mass, from the viewpoints of stability of the self-dispersed state, stabilization of the particle shape in an aqueous medium by hydrophobic interaction between alicyclic hydrocarbon groups, and reduction of the amount of water-soluble components by appropriate degree of hydrophobization of the particles. The content is particularly preferably from 50% by mass to 80% by mass.

When the content of structural unit derived from the alicyclic (meth)acrylate is 20% by mass or more, fixability may be ameliorated and blocking may be prevented. On the other hand, when the content of structural unit derived from the alicyclic (meth)acrylate is 90% by mass or less, the stability of the polymer particles is enhanced.

The self-dispersing polymer according to the invention may include hydrophobic structural units that include (i) the structural unit derived from the alicyclic (meth)acrylate and, further, (ii) another (additional) structural unit, if necessary. The monomer forming the additional structural unit is not particularly limited so long as it is a monomer that is copolymerizable with the alicyclic (meth)acrylate and the below-described hydrophilic group-containing monomer, and any known monomer may be used.

Specific examples of the monomer forming the additional structural unit (hereinafter referred to as "additional copolymerizable monomer" in some cases) include alkyl (meth) acrylates such as methyl (meth)acrylate, ethyl (meth)acrylate, isopropyl (meth)acrylate, n-propyl (meth)acrylate, n-butyl (meth)acrylate, isobutyl (meth)acrylate, t-butyl (meth)acrylate, hexyl (meth)acrylate, and ethylhexyl (meth) acrylate; aromatic ring-containing (meth)acrylates such as benzyl (meth)acrylate and phenoxyethyl (meth)acrylate; styrenes such as styrene, α-methylstyrene and chlorostyrene; dialkylaminoalkyl (meth)acrylates such as dimethylaminoethyl (meth)acrylate; and (meth)acrylamides such as N-hydroxyalkyl (meth)acrylamide (such as N-hydroxymethyl (meth)acrylamide, N-hydroxyethyl (meth)acrylamide and N-hydroxybutyl (meth)acrylamide), and N-alkoxyalkyl (meth)acrylamides (such as N-methoxymethyl (meth)acrylamide, N-ethoxymethyl (meth)acrylamide, N-(n-, iso-)butoxymethyl (meth)acrylamide, N-methoxyethyl (meth)acrylamide, N-ethoxyethyl (meth)acrylamide and N-(n-, iso-) butoxyethyl (meth)acrylamide).

Among them, the additional copolymerizable monomer is preferably at least one (meth)acrylate that contains a chain alkyl group having from 1 to 8 carbon atoms, more preferably a (meth)acrylate having a chain alkyl group having from 1 to 4 carbon atoms, and particularly preferably a methyl (meth) acrylate or ethyl (meth)acrylate, from the viewpoints of the flexibility of the polymer skeleton or the ease of adjusting the glass transition temperature (Tg) and the viewpoint of the dispersion stability of the self-dispersing polymer. Here, the chain alkyl group refers to an alkyl group having a linear or branched chain.

Furthermore, a (meth)acrylate containing an aromatic group is also preferable as an additional copolymerizable monomer in the invention.

When the polymer includes an aromatic group-containing (meth)acrylate as an additional copolymerizable monomer, the content of the structural unit derived from the aromatic group-containing (meth)acrylate is preferably 40% by weight or less, more preferably 30% by weight or less, and particularly preferably 20% by weight or less, from the viewpoint of the dispersion stability of the self-dispersing polymer particles.

When using a styrenic monomer as an additional copolymerizable monomer, the content of the structural unit derived from the styrenic monomer is preferably 20% by mass or less, more preferably 10% by mass or less, and even more preferably 5% by mass or less, and it is particularly preferable that the self-dispersing polymer does not include a structural unit derived from a styrenic monomer from the viewpoint of the stability of resultant self-dispersing polymer particles.

Here, the styrenic monomer refers to any of styrene, a substituted styrene (such as α-methylstyrene or chlorostyrene), or a styrene macromer having a polystyrene structural unit.

In the present invention, the additional copolymerizable monomer may be used singly or in combination of two or more thereof. When the self-dispersing polymer includes the additional structural unit, the content of the additional structural unit is preferably from 10 to 80 mass %, more preferably from 15 to 75 mass %, and particularly preferably from 20 to 70 mass %. When a combination of two or more monomers for forming the additional structural units is used, the total content thereof is preferably within the above range.

(Hydrophilic Structural Unit)

The self-dispersing polymer in the present invention may contain at least one kind of hydrophilic structural unit. The hydrophilic structural unit is not particularly limited so long as it is derived from a hydrophilic group-containing monomer. The hydrophilic structural units contained in the self-dispersing polymer may be derived from one kind of hydrophilic group-containing monomer or derived from two or more kinds of hydrophilic group-containing monomers. The hydrophilic group is not particularly limited, and may be either a dissociative group or a nonionic hydrophilic group.

In the present invention, it is preferable that the hydrophilic groups contained in the self-dispersing polymer include at least one kind of dissociative group, and more preferably include at least one kind of anionic dissociative group, from the viewpoints of promoting the self-dispersibility and enhancing the stability of the formed emulsified or dispersed state. Examples of the anionic dissociative group include a carboxyl group, a phosphoric acid group, and a sulfonic acid group. Among them, a carboxyl group is preferable from the viewpoint of the fixing property of an ink containing the self-dispersing polymer particles.

The hydrophilic group-containing monomer in the present invention is preferably a dissociative group-containing monomer, and preferably a dissociative group-containing monomer having a dissociative group and an ethylenically unsaturated bond, from the viewpoint of self-dispersibility.

Examples of the dissociative group-containing monomer include an unsaturated carboxylic acid monomer, an unsaturated sulfonic acid monomer, and an unsaturated phosphoric acid monomer.

Specific examples of the unsaturated carboxylic acid monomer include acrylic acid, methacrylic acid, crotonic acid, itaconic acid, maleic acid, fumaric acid, citraconic acid, and 2-methacryloyloxy methyl succinic acid. Specific examples of the unsaturated sulfonic acid monomer include styrene sulfonic acid, 2-acrylamide-2-methylpropane sulfonic acid, 3-sulfopropyl (meth)acrylate, and bis(3-sulfopropyl) itaconate. Specific examples of the unsaturated phosphoric acid monomer include vinyl phosphonic acid, vinyl phosphate, bis(methacryloxyethyl) phosphate, diphenyl-2-acryloyloxyethyl phosphate, diphenyl-2-methacryloyloxyethyl phosphate, and dibutyl-2-acryloyloxyethyl phosphate.

Among the dissociative group-containing monomers, unsaturated carboxylic acid monomers are preferable, and at least one of acrylic acid or methacrylic acid is more preferable, from the viewpoint of dispersion stability and jetting stability.

Examples of monomers having a nonionic hydrophilic group include ethylenic unsaturated monomers containing a (poly)ethyleneoxy group or a polypropyleneoxy group, such as 2-methoxyethyl acrylate, 2-(2-methoxyethoxy)ethyl acrylate, 2-(2-methoxyethoxy)ethyl methacrylate, ethoxytriethylene glycol methacrylate, methoxypolyethylene glycol (molecular weight: from 200 to 1000) monomethacrylate and polyethylene glycol (molecular weight: from 200 to 1000) monomethacrylate; and ethylenic unsaturated monomers having a hydroxyl group such as hydroxymethyl (meth)acrylate, 2-hydroxyethyl (meth)acrylate, 2-hydroxypropyl (meth) acrylate, 4-hydroxybutyl (meth)acrylate, hydroxypentyl (meth)acrylate and hydroxyhexyl (meth)acrylate.

In regard to monomers having a nonionic hydrophilic group, an ethylenic unsaturated monomer having an alkyl ether at a terminal thereof is preferable to an ethylenic unsaturated monomer having a hydroxyl group at a terminal thereof, from the viewpoint of the stability of the particles and the content of water-soluble component.

Regarding the hydrophilic structural unit in the invention, it is preferable that the hydrophilic structural units contained in the self-dispersing polymer include only hydrophilic structural units each having an anionic dissociative group or include hydrophilic structural units each having an anionic dissociative group and hydrophilic structural units each having a nonionic hydrophilic group.

It is also preferable that the hydrophilic structural units contained in the self-dispersing polymer include two or more types of hydrophilic structural units having an anionic dissociative group, or include two or more types of hydrophilic structural units including a hydrophilic structural unit having an anionic dissociative group and a hydrophilic structural unit having a nonionic hydrophilic group in combination.

The content of hydrophilic structural unit in the self-dispersing polymer is preferably 25% by mass or less, more preferably from 1 to 25% by mass, even more preferably from 2 to 23% by mass, and particularly preferably from 4 to 20% by mass, from the viewpoint of viscosity and stability over time.

When the polymer has two or more kinds of hydrophilic structural units, the total content of the hydrophilic structural units is preferably in the range described above.

The content of structural unit having an anionic dissociative group in the self-dispersing polymer is preferably in a range such that the acid value of the self-dispersing polymer is in the below-described suitable range.

Furthermore, the content of structural unit having a nonionic hydrophilic group is preferably from 0 to 25% by mass, more preferably from 0 to 20% by mass, and particularly preferably from 0 to 15% by mass, from the viewpoint of jetting stability and stability over time.

When the self-dispersing polymer has an anionic dissociative group, the acid value (mg KOH/g) is preferably from 20 to 200, more preferably from 22 to 120, and still more preferably from 25 to 100, from the viewpoints of self-dispersibility, the content of water-soluble component, and the fixability of an ink containing the self-dispersing polymer. The acid value is particularly preferably from 30 to 80. When the acid value is 20 or greater, the particles can be dispersed more stably, and when the acid value is 200 or smaller, the water-soluble component can be reduced.

The self-dispersing polymer according to the invention is preferably a polymer obtained by polymerizing at least three monomers that are an alicyclic (meth)acrylate, an additional copolymerizable monomer and a hydrophilic group-containing monomer, from the viewpoint of dispersion stability, and is more preferably a polymer obtained by polymerizing at least three monomers that are an alicyclic (meth)acrylate, a (meth)acrylate containing an alkyl group having a linear or branched chain of from 1 to 8 carbon atoms, and a hydrophilic group-containing monomer.

According to the invention, from the viewpoint of dispersion stability, the self-dispersing polymer is preferably substantially free from, more preferably completely free from, structural units having a highly hydrophobic substituent derived from an aromatic group-containing macromonomer or a (meth)acrylate having a linear or branched alkyl group of 9 or more carbon atoms.

The self-dispersing polymer in the present invention may be a random copolymer in which the respective structural units are introduced irregularly or a block copolymer in which the respective structural units are introduced regularly. When the self-dispersing polymer is a block copolymer, the respective structural units may be introduced at any order during the preparation of the block copolymer, and the same structural component may be used two or more times during the preparation of the block copolymer. However, the self-dispersing polymer is preferably a random copolymer in consideration of versatility and productivity.

The range for the molecular weight of the self-dispersing polymer is preferably from 3,000 to 200,000, more preferably from 10,000 to 200,000, and further preferably from 30,000 to 150,000, in terms of the weight average molecular weight. The amount of the water-soluble component can be regulated effectively when the weight average molecular weight is 3,000 or more. Further, the self-dispersion stability can be enhanced when the weight average molecular weight is 200,000 or less.

The weight average molecular weight may be measured with a gel permeation chromatography (GPC).

The glass transition temperature (Tg) of the self-dispersing polymer according to the invention is preferably from 40 to 180° C., more preferably from 60 to 170° C., and particularly preferably from 70 to 150° C. When the glass transition temperature is 40° C. or higher, scratch resistance and blocking resistance of a recorded material obtained by recording with an ink containing the self-dispersing polymer improve. When the glass transition temperature is 180° C. or lower, abrasion resistance is improved.

In the present invention, the self-dispersing polymer is preferably a vinyl polymer which includes a structure derived from an alicyclic (meth)acrylate at a copolymerization ratio of from 20% by mass to 90% by mass and at least one of a structure derived from a dissociative group-containing monomer or a structure derived from a (meth)acrylate containing a chain alkyl group having from 1 to 8 carbon atoms, and which has an acid value of from 20 to 120, a total hydrophilic structural unit content of 25% by mass or less, and a weight average molecular weight of from 3000 to 200,000, from the viewpoint of regulating the hydrophilicity-hydrophobicity balance of the polymer.

The self-dispersing polymer is more preferably a vinyl polymer which includes a structure derived from a bicyclic or higher-cyclic (meth)acrylate at a copolymerization ratio of from 30% by mass to 90% by mass (preferably from 30 to 80% by mass), a structure derived from a (meth)acrylate containing a chain alkyl group having from 1 to 4 carbon atoms at a copolymerization ratio of from 10 to 80% by mass (preferably, from 10 to 65% by mass), and a structure derived from a carboxyl group-containing monomer in such an amount as to provide an acid value in the range of from 25 to 100, and which has a total hydrophilic structural unit content of 25% by mass or less and a weight average molecular weight of from 10,000 to 200,000.

Furthermore, the self-dispersing polymer is preferably a vinyl polymer which includes a structure derived from a bicyclic or higher-cyclic (meth)acrylate at a copolymerization ratio of from 40% by mass to 80% by mass (preferably from 40 to 75% by mass) and at least one of a structure derived from methyl (meth)acrylate or a structure derived from ethyl (meth)acrylate at a total copolymerization ratio of from 20 to 70% by mass (preferably from 20 to 55% by mass), which includes at least one of a structure derived from acrylic acid or a structure derived from methacrylic acid at such a total amount as to provide an acid value in the range of from 30 to 80, and which has a total hydrophilic structural unit content of 25% by mass or less and a weight average molecular weight of from 30,000 to 150,000.

Exemplary compounds B-1 to B-13 are listed below as specific examples of the self-dispersing polymer, but the invention is not limited thereto. Furthermore, the ratio described within the parentheses represents the mass ratio of the copolymerization components.

B-1: Methyl methacrylate/isobornyl methacrylate/methacrylic acid copolymer (20/72/8)

B-2: Methyl methacrylate/isobornyl methacrylate/benzyl methacrylate/methacrylic acid copolymer (30/50/14/6)

B-3: Methyl methacrylate/dicyclopentanyl methacrylate/methacrylic acid copolymer (40/50/10)

B-4: Methyl methacrylate/dicyclopentanyl methacrylate/phenoxyethyl methacrylate/methacrylic acid copolymer (30/50/14/6)

B-5: Methyl methacrylate/isobornyl methacrylate/methoxypolyethylene glycol methacrylate (n=2)/methacrylic acid copolymer (30/54/10/6)

B-6: Methyl methacrylate/dicyclopentanyl methacrylate/methoxypolyethylene glycol methacrylate (n=2)/methacrylic acid copolymer (54/35/5/6)

B-7: Methyl methacrylate/adamantyl methacrylate/methoxypolyethylene glycol methacrylate (n=23)/methacrylic acid copolymer (30/50/15/5)

B-8: Methyl methacrylate/isobornyl methacrylate/dicyclopentanyl methacrylate/methacrylic acid copolymer (20/50/22/8)

B-9: Ethyl methacrylate/cyclohexyl methacrylate/acrylic acid copolymer (50/45/5)

B-10: Isobutyl methacrylate/cyclohexyl methacrylate/acrylic acid copolymer (40/50/10)

B-11: n-butyl methacrylate/cyclohexyl methacrylate/styrene/acrylic acid copolymer (30/55/10/5)

B-12: Methyl methacrylate/dicyclopentenyloxyethyl methacrylate/methacrylic acid copolymer (40/52/8)

B-13: Lauryl methacrylate/dicyclopentenyloxyethyl methacrylate/methacrylic acid copolymer (25/65/10)

The method for producing a self-dispersing polymer in the invention is not particularly limited, and the self-dispersing polymer may be produced by copolymerizing a mixture of monomers by a known polymerization method. Among polymerization methods, polymerizing in an organic medium is more preferable, and a solution polymerization method is particularly preferable, from the viewpoint of jetting stability of an ink containing the self-dispersing polymer.

In regard to the method for producing a self-dispersing polymer of the invention, the self-dispersing polymer may be produced by allowing a mixture that includes a monomer mixture and that optionally includes at least one of an organic solvent or a radical polymerization initiator to undergo a copolymerization reaction under an inert gas atmosphere.

From the viewpoint of aggregation speed, the self-dispersing polymer particles in the present invention preferably include a polymer synthesized in an organic solvent, wherein the polymer has carboxyl groups, all or some of the carboxyl groups of the polymer are neutralized (to give an acid value of preferably from 20 to 100), and the polymer is prepared in the form of a polymer dispersion in which water constitutes the continuous phase. In other words, the production of the self-dispersing polymer particles in the present invention preferably includes a step of synthesizing a polymer in an organic solvent and a dispersing step of forming an aqueous dispersion in which at least some of the carboxyl groups of the polymer are neutralized.

The dispersion step preferably includes the following substep (1) and substep (2).

Substep (1): substep of stirring a mixture containing a polymer (water-insoluble polymer), an organic solvent, a neutralizing agent, and an aqueous medium, Substep (2): substep of removing the organic solvent from the mixture.

The substep (1) is preferably a treatment that includes first dissolving the polymer (water-insoluble polymer) in the organic solvent and then gradually adding the neutralizing agent and the aqueous medium, and mixing and stirring the mixture to obtain a dispersion. By adding the neutralizing agent and the aqueous medium to the solution of the water-insoluble polymer dissolved in the organic solvent, self-dispersing polymer particles whose diameter is highly stable during storage can be obtained without requiring strong shearing force.

The method of stirring the mixture is not particularly limited. A mixing and stirring apparatus that is used generally and, optionally, a disperser such as an ultrasonic disperser or a high-pressure homogenizer, can be used.

Preferable examples of the organic solvent include alcohol solvents, ketone solvents and ether solvents.

Examples of alcohol solvents include isopropyl alcohol, n-butanol, t-butanol, and ethanol. Examples of ketone solvents include acetone, methyl ethyl ketone, diethyl ketone, and methyl isobutyl ketone. Examples of ether solvents include dibutyl ether and dioxane. Among the solvents, ketone solvents such as methyl ethyl ketone and alcohol solvents such as isopropyl alcohol are preferable. Further, it is preferable to use of isopropyl alcohol and methyl ethyl ketone in combination, with a view to moderating the change of polarity when the phase is inverted from an oil phase to an aqueous phase. When the above solvents are used, self-dispersing polymer particles having a very small particle diameter that are free from aggregation percipitation or adhesion between the particles and that have high dispersion stability may be obtained.

The neutralizing agent is used to neutralize some or all of the dissociative groups so that the self-dispersing polymer forms a stable emulsified or dispersed state in water. When the self-dispersing polymer of the present invention has an anionic dissociative group (for example, carboxyl group) as the dissociative group, examples of the neutralizing agent include basic compounds such as organic amine compounds, ammonia, and alkali metal hydroxides. Examples of the organic amine compounds include monomethyl amine, dimethyl amine, trimethyl amine, monoethyl amine, diethyl amine, triethyl amine, monopropyl amine, dipropyl amine, monoethanol amine, diethanol amine, triethanol amine, N,N-dimethyl-ethanol amine, N,N-diethyl-ethanol amine, 2-diethylamino-2-methyl-1-propanol, 2-amino-2-methyl-1-propanol, N-methyldiethanol amine, N-ethyldiethanol amine, monoisopropanol amine, diisopropanol amine, and triisopropanol amine. Examples of the alkali metal hydroxides include lithium hydroxide, sodium hydroxide and potassium hydroxide. Among them, sodium hydroxide, potassium hydroxide, triethylamine, and triethanol amine are preferable from the viewpoint of improving the dispersion stability of the self-dispersing polymer particles of the present invention in water.

The basic compound is used preferably in an amount of from 5 to 120 mol %, more preferably from 10 to 110 mol %, and further preferably from 15 to 100 mol %, relative to 100 mol % of the dissociative groups. When the basic compound is in an amount of 5 mol % or more relative to 100 mol % of the dissociative groups, the effect of stabilizing the dispersion of the particles in water can be obtained. When the amount of the basic compound is 120% or less relative to 100 mol % of the dissociative groups, the effect of decreasing the amount of water-soluble component may be provided.

In the substep (2), the organic solvent is removed, by distillation, from the dispersion obtained in the substep (1) using a common method such as distillation under reduced pressure, whereby phase inversion into an aqueous system occurs and an aqueous dispersion of the self-dispersing polymer particles is obtained. The organic solvent has substantially been removed from the obtained aqueous dispersion, and the amount of the remaining organic solvent is preferably 0.2% by mass or less, and more preferably 0.1% by mass or less.

The volume average particle diameter of the resin particles (latex particles) is preferably in the range of from 10 nm to 1 μm, more preferably in the range of from 10 nm to 200 nm, even more preferably in the range of from 10 nm to 100 nm, and particularly preferably in the range of from 10 nm to 50 nm. When the volume average particle diameter is 10 nm or more, production suitability can be enhanced, and when the volume average particle diameter is 1 μm or less, storage stability can be enhanced.

The particle size distribution of the resin particles is not particularly limited, and may be a broad particle size distribution or a monodispersed particle size distribution. It is possible to use a mixture of two or more kinds of water-insoluble particles.

The volume average particle diameter and particle size distribution of the resin particles are obtained by measuring particle diameters by a dynamic light scattering method, using a NANOTRACK particle size distribution analyzer UPA-EX150 (tradename, manufactured by Nikkiso Co., Ltd.).

The glass transition temperature (Tg) of the resin particles is preferably 30° C. or higher, more preferably 40° C. or higher, and even more preferably 50° C. or higher, from the viewpoint of the storage stability of the ink.

The particle size distribution of the resin particles is not particularly limited, and may be a broad particle size distribution or a monodispersed particle size distribution. It is also possible to use a mixture of two or more kinds of resin particles having a monodispersed particle size distribution.

The resin particles (particularly, the self-dispersing polymer particles) may be used singly, or as a mixture of two or more kinds thereof.

The content of the resin particles in the ink is preferably from 0.5 to 20% by mass, more preferably from 2 to 20% by mass, and even more preferably from 3 to 15% by mass, relative to the total mass of the ink.

<Surfactant>

The ink composition according to the present invention may contain a surfactant, if necessary. The surfactant may be used as a surface-tension controller.

An example of an effective surface-tension controller is a compound having a structure that has both a hydrophilic moiety and a hydrophobic moiety in a molecule thereof, and any of an anionic surfactant, a cationic surfactant, an amphoteric surfactant, a nonionic surfactant, or a betaine surfactant may be used. Further, the dispersants (polymeric dispersant) described above may be used as surfactants.

When the ink contains a surfactant, the content of surfactant is preferably such an amount that the surface tension of the ink is adjusted to be from 20 to 60 mN/m, in view of achieving favorable ink jetting by an inkjet method. The surface tension of the ink is more preferably from 20 to 45 mN/m, and even more preferably from 25 to 40 mN/m.

The specific amount of surfactant in the ink is not particularly limited, and is preferably such an amount as to achieve an ink surface tension in a preferable range as described above. The amount of surfactant is preferably 1% by mass or more, more preferably from 1 to 10% by mass, and even more preferably from 1 to 3% by mass.

<Other Components>

The ink may further contain various additives as other components according to necessity, in addition to the components described above.

Examples of the various additives include known additives such as an ultraviolet absorber, an anti-fading agent, an anti-mildew agent, a pH adjustor, an anti-rust agent, an antioxidant, an emulsion stabilizer, a preservative, an anti-foam agent, a viscosity adjustor, a dispersion stabilizer, and a chelating agent.

-Properties of Ink-

The surface tension (25° C.) of the ink according to the present invention is preferably from 20 mN/m to 60 mN/m, more preferably from 20 mN/m to 45 mN/m, and even more preferably from 25 mN/m to 40 mN/m.

The surface tension of the ink is measured under the conditions of a temperature of 25° C. using an automatic surface tensiometer CBVP-Z (tradename, manufactured by Kyowa Interface Science Co., Ltd.).

The viscosity of the ink according to the invention at 25° C. is preferably from 1.2 mPa·s to 15.0 mPa·s, more preferably from 2 mPa·s to lower than 13 mPa·s, and even more preferably from 2.5 mPa·s to lower than 10 mPa·s.

The viscosity of the ink is measured using a VISCOMETER TV-22 (manufactured by TOKI SANGYO CO., LTD.) at 25° C.

EXAMPLES

Hereinafter, the present invention is described in detail by way of examples. However, the invention is not limited to the following examples so long as the gist of the invention is retained. In the following, "part" represents "part by mass" unless indicated otherwise.

The weight average molecular weight was measured by gel permeation chromatography (GPC). GPC was performed using an HLC-8020 GPC (manufactured by Tosoh Corp.) and using three columns of TSKGEL SUPER HZM-H, TSKGEL SUPER HZ4000, and TSKGEL SUPER HZ200 (tradenames, all manufactured by Tosoh Corp.) connected in series, and using tetrahydrofuran (THF) as an eluent. The GPC conditions were as follows:

sample concentration: 0.45% by mass,
flow rate: 0.35 ml/min,
sample injection amount: 10 μl, and
measurement temperature: 40° C.

An RI detector was used for the detection. A calibration curve was determined from eight samples of "STANDARD SAMPLE TSK STANDARD POLYSTYRENE", which were "F-40", "F-20", "F-4", "F-1", "A-5000", "A-2500", "A-1000" and "n-propylbenzene" manufactured by Tosoh Corp.

Examples 1 to 44 and Comparative Examples 1 to 12

<Preparation of Ink>

(Synthesis of Polymer dispersant P-1)

A polymer dispersant P-1 was synthesized as described below, according to the following scheme.

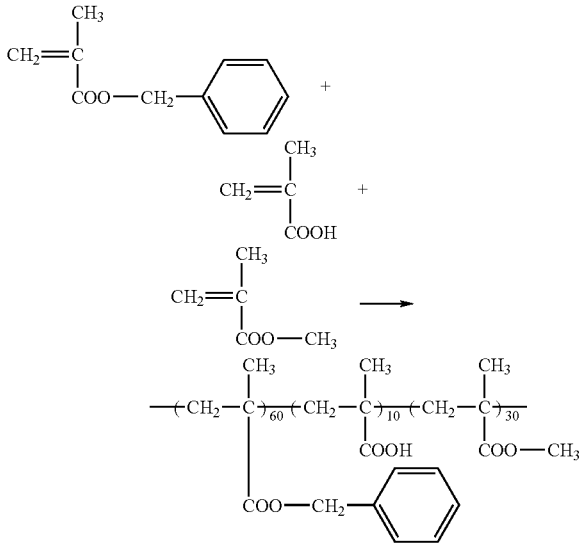

P-1

Methyl ethyl ketone (88 g) was added into a 1000 ml three-neck flask equipped with a stirrer and a condenser tube, and heated to 72° C. under a nitrogen atmosphere. Separately, 0.85 g of dimethyl-2,2'-azobisisobutyrate, 60 g of benzyl methacrylate, 10 g of methacrylic acid, and 30 g of methyl methacrylate were dissolved in 50 g of methyl ethyl ketone to form a solution. The solution was added dropwise to the liquid in the flask over three hours. After the dropwise addition was completed, the reaction was further continued for one hour. Then, a solution obtained by dissolving 0.42 g of dimethyl 2,2'-azobisisobutyrate in 2 g of methyl ethyl ketone was added to the reaction solution, and the reaction solution was heated to 78° C. and heated at this temperature for 4 hours. The obtained reaction solution was reprecipitated twice with an excess quantity of hexane, and the precipitated resin was dried to obtain 96 g of the polymer dispersant P-1.

The composition of the obtained resin was identified with $^{1}$H-NMR. The weight average molecular weight (Mw) was determined by a GPC method, and was found to be 44,600. Furthermore, the acid value of the resin was obtained in accordance with the method described in JIS Standard (JIS- K0070 (1992), the disclosure of which is incorporated by reference herein), and was found to be 65.2 mgKOH/g.

(Dispersion of Resin-Coated Pigment Particles)

10 parts of pigment blue 15:3 (trade name: PHTHALOCYANINE BLUE A220, manufactured by Dainichiseika Color & Chemicals Mfg. Co., Ltd.), 5 parts of the polymer dispersant P-1, 42 parts of methyl ethyl ketone, 5.5 parts of an aqueous solution of NaOH (1 mol/L), and 87.2 parts of ion-exchanged water were mixed, and the mixture was dispersed with a bead mill for 2 to 6 hours using zirconia beads with a diameter of 0.1 mm.

Methyl ethyl ketone was removed from the obtained dispersion at 55° C. under reduced pressure, and a part of the water was removed, whereby a dispersion containing resin-coated pigment particles and having a pigment concentration of 10.2 mass % was obtained.

(Synthesis and Preparation of Self-Dispersing Polymer Particles)

-Preparation of Self-Dispersing Polymer (B-1)-

540.0 g of methyl ethyl ketone was introduced into a 2-liter three-necked flask equipped with a stirrer, a thermometer, a reflux cooling tube and a nitrogen gas introduction tube, and was heated to 75° C. While the temperature inside the reaction vessel was maintained at 75° C., a mixture solution obtained by mixing 108 g of methyl methacrylate, 388.8 g of isobornyl methacrylate, 43.2 g of methacrylic acid, 108 g of methyl ethyl ketone, and 2.16 g of "V-601" (manufactured by Wako Pure Chemical Industries, Ltd.) was added dropwise at a constant rate, so that the dropwise addition was completed in 2 hours. After completion of the dropwise addition, a solution formed by 1.08 g of "V-601" and 15.0 g of methyl ethyl ketone was added thereto, and the mixture was stirred at 75° C. for 2 hours. Furthermore a solution formed by 0.54 g of "V-601" and 15.0 g of methyl ethyl ketone was added thereto, and the contents of the flask were stirred at 75° C. for 2 hours. Subsequently, the temperature inside the flask was raised to 85° C., and stirring was continued for another 2 hours, and a resin solution of a methyl methacrylate/isobornyl methacrylate/methacrylic acid (=20/72/8 (mass ratio)) copolymer was obtained.

The weight average molecular weight (Mw) of the obtained copolymer was 61000 (as measured by gel permeation chromatography (GPC) and calculated as polystyrene-equivalent value), and the acid value was found to be 52.1 (mg KOH/g).

Next, 588.2 g of the obtained resin solution was weighed, and 165 g of isopropanol and 120.8 ml of aqueous 1 mol/L NaOH solution were added. Then, the temperature inside the reaction vessel was raised to 80° C. Next, 718 g of distilled water was added dropwise at a rate of 20 ml/min so that the copolymer resin was dispersed in water. Thereafter, the resultant was allowed to stand at an atmospheric pressure at a reaction vessel inside temperature of 80° C. for 2 hours, and then 85° C. for 2 hours, and then at 90° C. for 2 hours in order to remove the solvent. Then, the pressure inside the reactor was reduced, and the isopropanol, methyl ethyl ketone, and distilled water were removed to provide a water dispersion of the self-dispersing polymer particles B-1 having a solid content of 26.0 mass %.

(1-1) Preparation of Cyan Pigment Ink C-1

Cyan pigment ink C-1 was prepared by mixing the dispersion of the resin-coated pigment particles, the water dispersion of the self-dispersing polymer particles B-1, a hydrophilic organic solvent, a surfactant and ion-exchanged water, thereby obtaining a mixture having the following composition. Then, the mixture was filtered through a 5-μm membrane filter, and thus cyan pigment ink C-1 was obtained.

| <Composition of cyan pigment ink C-1> | |
|---|---|
| Cyan pigment (Pigment Blue 15:3) | 4% by mass |
| Polymer dispersant P-1 | 2% by mass |
| Self-dispersing polymer particles B-1 (solid content) | 6% by mass |
| Compound represented by the following Structural Formula (1) (AO = ethyleneoxy, l + m + n ≈ 6, SP value: 23.2) | 15% by mass |
| OLFINE E1010 (manufactured by Nissin Chemical Industry Co., Ltd.; surfactant) | 1% by mass |
| Ion-exchanged water | Balance (to adjust the total amount of the composition to 100% by mass) |

Structural Formula (1)

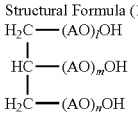

The pH of the cyan pigment ink C-1 was measured using a pH meter (WM-50EG manufactured by DKK-Toa Corp.), and the pH value was found to be 8.5.

(1-2) Preparation of Cyan Pigment Ink C-2

Cyan pigment ink C-2 was prepared in the same manner as the preparation of cyan pigment ink C-1, except that the amount of self-dispersing polymer particles B-1 in the composition was changed from 6% by mass to 10% by mass.

(1-3) Preparation of Cyan Pigment Ink C-3

Cyan pigment ink C-3 was prepared in the same manner as the preparation of cyan pigment ink C-1, except that the amount of the self-dispersing polymer particles B-1 in the composition was changed from 6% by mass to 15% by mass.

(2-1) Preparation of Magenta Pigment Ink M-1

Magenta pigment ink M-1 was prepared in the same manner as the preparation of cyan pigment ink C-1, except that the Pigment Blue 15:3 used as the pigment in the preparation of the cyan pigment ink C-1 was changed to CROMOPHTAL JET MAGENTA DMQ (PR-122, manufactured by Ciba Specialty Chemicals, Inc.).

The pH of magenta pigment ink M-1 was measured using a pH meter (WM-50EG manufactured by DKK-Toa Corp.), and the pH value was found to be 8.5.

(2-2) Preparation of Magenta Pigment Ink M-2

Magenta pigment ink M-2 was prepared in the same manner as the preparation of magenta pigment ink M-1, except that the amount of the self-dispersing polymer particles B-1 in the composition was changed from 6% by mass to 10% by mass.

(2-3) Preparation of Magenta Pigment Ink M-3

Magenta pigment ink M-3 was prepared in the same manner as the preparation of magenta pigment ink M-1, except that the amount of the self-dispersing polymer particles B-1 in the composition was changed from 6% by mass to 15% by mass.

(3-1) Preparation of Yellow Pigment Ink Y-1

Yellow pigment ink Y-1 was prepared in the same manner as the preparation of cyan pigment ink C-1, except that the Pigment Blue 15:3 used as the pigment in the preparation of the cyan pigment ink C-1 was changed to IRGALITE YELLOW GS (PY74, manufactured by Ciba Specialty Chemicals, Inc.).

The pH of yellow pigment ink Y-1 was measured using a pH meter (WM-50EG manufactured by DKK-Toa Corp.), and the pH value was found to be 8.5.

(3-2) Preparation of Yellow Pigment Ink Y-2

Yellow pigment ink Y-2 was prepared in the same manner as the preparation of yellow pigment ink Y-1, except that the amount of the self-dispersing polymer particles B-1 in the composition was changed from 6% by mass to 10% by mass.

(3-3) Preparation of Yellow Pigment Ink Y-3

Yellow pigment ink Y-3 was prepared in the same manner as the preparation of yellow pigment ink Y-1, except that the amount of the self-dispersing polymer particles B-1 in the composition was changed from 6% by mass to 15% by mass.

(4-1) Preparation of Black Pigment Ink K-1

Black pigment ink K-1 was prepared in the same manner as the preparation of cyan pigment ink C-1, except that the dispersion of the resin-coated pigment particles prepared in the preparation of the cyan pigment ink C-1 was changed to a pigment dispersion (CAB-β-JET TM200 (carbon black), manufactured by CABOT Corp.) and the composition was changed to the following composition.

| <Composition of black pigment ink K-1> | |
|---|---|
| Carbon black | 4% by mass |
| Polymer dispersant P-1 | 2% by mass |
| Self-dispersing polymer particle B-1 (solid content) | 6% by mass |
| Compound represented by Structural Formula (1) (AO = ethyleneoxy (EO), l + m + n ≈ 6, SP value: 23.2) | 15% by mass |
| OLFINE E1010 (manufactured by Nissin Chemical Industry Co., Ltd.; surfactant) | 1% by mass |
| Ion-exchanged water | Balance (to adjust the total amount of the composition to 100% by mass) |

The pH of black pigment ink K-1 was measured using a pH meter (WM-50EG manufactured by DKK-Toa Corp.), and the pH value was found to be 8.5.

(4-2) Preparation of Black Pigment Ink K-2

Black pigment ink K-2 was prepared in the same manner as the preparation of black pigment ink K-1, except that the amount of self-dispersing polymer particles B-1 in the composition was changed from 6% by mass to 10% by mass.

(4-3) Preparation of Black Pigment Ink K-3

Black pigment ink K-3 was prepared in the same manner as in the preparation of black pigment ink K-1, except that the amount of the self-dispersing polymer particles B-1 in the composition was changed from 6% by mass to 15% by mass.

(5) Preparation of Pigment Inks C-4, M-4, Y-4 and K-4

Cyan pigment ink C-4, magenta pigment ink M-4, yellow pigment ink Y-4 and black pigment ink K-4 were prepared in the same manner as the preparation of cyan pigment ink C-1, magenta pigment ink M-1, yellow pigment ink Y-1 and black pigment ink K-1, respectively, except that, in each composition, the amount of the self-dispersing polymer particles B-1 was changed from 6% by mass to 1.5% by mass, and the amount of the compound represented by Structural Formula (I) was changed from 15% by mass to 10% by mass.

(6) Preparation of Pigment Inks C-5, M-5, Y-5 and K-5 for Comparison

Cyan pigment ink C-5, magenta pigment ink M-5, yellow pigment ink Y-5 and black pigment ink K-5 were prepared in the same manner as the preparation of cyan pigment ink C-1, magenta pigment ink M-1, yellow pigment ink Y-1 and black pigment ink K-1, respectively, except that, in each composition, the amount of the self-dispersing polymer particles B-1 was changed from 6% by mass to 1% by mass.

(7) Preparation of Pigment Inks C-6, M-6, Y-6 and K-6 for Comparison

Cyan pigment ink C-6, magenta pigment ink M-6, yellow pigment ink Y-6 and black pigment ink K-6 were prepared in the same manner as the preparations of cyan pigment ink C-1, magenta pigment ink M-1, yellow pigment ink Y-1 and black pigment ink K-1, respectively, except that, in each composition, the amount of the self-dispersing polymer particles B-1 was changed from 6% by mass to 3% by mass.

<Preparation of Treatment Liquid>

A treatment liquid was prepared by mixing the components of the following composition. The pH of the treatment liquid was measured using a pH meter (WM-50EG manufactured by DKK-Toa Corp.), and was found to be 1.21.

| <Composition of treatment liquid> | |
|---|---|
| Malonic acid | 7.5 g |
| Diethylene glycol monoethyl ether (Hereinafter, abbreviated to "DEGmEE") | 10 g |
| Ion-exchanged water | 7.5 g |

<Image Recording>

As shown in the following Table 1 and Table 2, U-LITE (basis weight 104.7 g/m$^2$), TOKUBISHI ART (basis weight 104.7 g/m$^2$) and OK TOPCOAT+(basis weight 104.7 g/m$^2$) were prepared as recording media (coated papers). As shown in the following Table 1 and Table 2, the solid content of the ink, the conveyance speed during ink drying treatment, the surface temperature of an image region, and the like were changed, and an image was recorded as described below.

<Jetting Method>

A combination of four color inks having the same solid content (solid content=12% by mass, 16% by mass, 21% by mass, 7.5% by mass, 7% by mass, or 9% by mass) selected from the cyan pigment inks, magenta pigment inks, yellow pigment inks, and black pigment inks obtained above, for example a combination of cyan pigment ink C-1, magenta pigment ink M-1, yellow pigment ink Y-1 and black pigment ink K-1, was used as an ink set. Recording of line images and solid images was performed by 4-color single pass recording, using the ink set and the treatment liquid. The recording of the line images was performed in a single-pass manner to record lines having thicknesses (1200 dpi) of one dot, two dots, and four dots, respectively, that extend in the fast scanning direction. The solid images were recorded by jetting the ink over an entire one surface of a sample which was prepared by cutting the recording medium to A5 size. Furthermore, general conditions of the recording were as follows.

<Recording>

(1) Treatment Liquid Applying Process

First, the treatment liquid was applied to an entire one surface of the recording medium in an application amount of 1.7 (g/m$^2$) using a roll coater of which application amount was controlled by an Anilox roller (from 100 to 300 lines/inch).

(2) First Treatment Process

Subsequently, the recording medium coated with the treatment liquid was subjected to a drying treatment and a penetration treatment under the conditions described below.

Air speed: 10 m/s

Temperature: the recording medium was heated from a side (rear surface side) of the recording medium that is opposite to the recording surface, using a contact-type plane heater, such that the surface temperature at the recorded surface side of the recording medium was adjusted to 60° C.

(3) Image Recording Process

Thereafter, the inks were jetted onto the surface of the recording medium that was coated with the treatment liquid, by an inkjet method under the conditions described below, whereby the line images and the solid images were recorded.

Head: 1,200 dpi/20 inch-wide piezo full line heads for four colors

Amount of ejected liquid droplets: Recording was performed in four droplet quantities of 0 pL, 2.0 pL, 3.5 pL and 4.0 pL Driving frequency: 30 kHz (4) Second Treatment Process (Ink Drying Treatment)

Subsequently, the recording medium to which the inks were deposited was dried under the following conditions.

Drying method: Drying by air blowing

Conveyance speed: 500 mm/s, 1200 mm/s, and 2500 mm/s

Air speed: 15 m/s

Temperature: The recording medium was heated from the side (rear surface side) of the recording medium that was opposite to the recording surface, using a contact-type plane heater, such that the surface temperature of the image region was adjusted to the values indicated in the following Table 1 and Table 2.

Further, the tackiness of the image region before passing between the pair of rollers described below was measured according to the following measurement method.

<Measurement of Tackiness>

As shown in FIG. 1, a slope having an inclination angle of 30 degrees was disposed at one end of the image region, and a ball made of SUS (stainless steel) with a diameter of 2 mm (mass: 0.327 g, ball surface: mirror surface) was allowed to roll down the slope from a point that was located at a slope distance of 10 mm (at a height of 5 mm) from the image region under an environment at 23° C. and 50% RH. The distance that the ball made of SUS rolled over the image region was measured. The measured values are shown in the following Table 1 and Table 2.

Based on the obtained results of tackiness, the time between the completion of recording (image formation) and the initiation of the subsequent fixing process was set as indicated in the following Table 1 and Table 2.

(5) Fixing Process

Subsequently, the image region was subjected to a heat-pressure-bonding treatment by allowing the recording medium to pass between a pair of rollers under the following conditions.

<Heat-Pressure-Bonding Conditions>

Silicone rubber roller (hardness 50°, nip width 5 mm)

Roller temperature: 70° C.

Pressure: 0.2 MPa

<Evaluation>

The line images and the solid images recorded as described above were evaluated according t the following criteria. The evaluation results are shown in the following Table 1 and Table 2.

-Abrasion Resistance-

Immediately after printing a solid image of 2 cm square on a recording medium, an unrecorded recording medium (the same recording medium as that used for recording (hereinafter, referred to as an unused sample in regard to the current evaluation)) was placed on the recording medium having the solid image of 2 cm square thereon, and was rubbed thereagainst reciprocatingly (back and forth) 10 times with a load of 150 kg/m$^2$. The degree of transfer of ink to the blank area of the unused sample was visually observed, and was evaluated according to the following evaluation criteria.

<Evaluation Criteria>

A: There is no transfer of ink at all.

B: Transfer of ink is hardly noticeable.

C: Moderate transfer of ink is observed.

D: Transfer of ink is significant.

-Offset Resistance-

When a solid image formed by the cyan pigment ink was recorded on a solid image formed by the magenta pigment ink, the degree of offset in a uniform image region after heat-pressure-bonding was observed by visual inspection, and was evaluated according to the following evaluation criteria using the degree of density unevenness as an index.

<Evaluation Criteria>

A: No offset is observed.

B: Practically non-problematic. Only a slight offset is observed in some part.

C: Occurrence of offset is observed.

D: Practically problematic. Occurrence of offset is significant.

-Image Quality (Printing Properties)-

Printing properties were evaluated according to the following evaluation criteria, with respect to the line of one-dot width, the line of two-dot width, and the line of four-dot width that were recorded on the recording medium.

<Evaluation Criteria>

A: All lines are uniform lines.

B: The line of 1-dot width is uniform, but non-uniformity in the line width or break in the line is observed in some parts of the line of 2-dot width and the line of 4-dot width.

C: The line of 1-dot width is uniform, but non-uniformity in the line width or break in the line is observed throughout the line of 2-dot width and the line of 4-dot width.

D: Non-uniformity in the line width or break in the line is significantly observed along the entire length of the lines.

Surface Gloss

The 60° mirror surface glosses at the surfaces of a non-image region of the post-recording recording medium (a portion at which the inks were not spotted) and of an unrecorded sheet of the recording medium was measured with a gloss meter (IG-331, manufactured by Horiba, Ltd.), and the difference in the surface gloss between the unrecorded recording medium and the non-image region was evaluated according to the following evaluation criteria. A smaller surface gloss difference indicates a superior image.

<Evaluation Criteria>

A: The difference from the glossiness of the unrecorded recording medium is within ±5%.

B: The difference from the glossiness of the unrecorded recording medium is within ±10%.

C: The difference from the glossiness of the unrecorded recording medium is ±15% or more.

D: The difference from the glossiness of the unrecorded recording medium is ±20% or more.

TABLE 1

| | Ink set (*1) | Recording medium | Solid content of ink [mass %] | Image region temperature [° C.] | Conveyance speed (*2) [mm/s] | Tackiness [mm] | Time from Image Formation [sec] | Image quality | Surface gloss | Abrasion resistance | Offset resistance |
|---|---|---|---|---|---|---|---|---|---|---|---|
| Example 1 | 1 | U-LITE | 12 | 40 | 500 | 80 | 7 | A | A | A | B |
| Example 2 | 2 | U-LITE | 16 | 60 | 500 | 90 | 7 | A | A | A | B |
| Example 3 | 2 | U-LITE | 16 | 80 | 500 | 95 | 7 | A | A | A | B |
| Example 4 | 3 | U-LITE | 21 | 80 | 500 | 113 | 7 | A | A | A | A |
| Example 5 | 3 | U-LITE | 21 | 80 | 1250 | 85 | 7 | A | A | B | A |
| Example 6 | 3 | U-LITE | 21 | 80 | 2500 | 45 | 7 | A | A | B | B |
| Example 7 | 1 | TOKUBISHI ART | 12 | 40 | 500 | 70 | 7 | A | A | A | B |
| Example 8 | 2 | TOKUBISHI ART | 16 | 40 | 500 | 94 | 7 | A | A | A | A |
| Example 9 | 3 | TOKUBISHI ART | 21 | 40 | 500 | 109 | 7 | A | A | A | A |
| Example 10 | 3 | TOKUBISHI ART | 21 | 40 | 500 | 99 | 5 | A | A | A | A |
| Example 11 | 3 | TOKUBISHI ART | 21 | 40 | 500 | 89 | 3 | A | A | A | A |
| Example 12 | 1 | TOKUBISHI ART | 12 | 60 | 500 | 75 | 7 | A | A | A | B |
| Example 13 | 2 | TOKUBISHI ART | 16 | 60 | 500 | 97 | 7 | A | A | A | A |
| Example 14 | 3 | TOKUBISHI ART | 21 | 60 | 500 | 111 | 7 | A | A | A | A |
| Example 15 | 1 | TOKUBISHI ART | 12 | 80 | 500 | 80 | 7 | A | A | A | B |
| Example 16 | 2 | TOKUBISHI ART | 16 | 80 | 500 | 100 | 7 | A | A | A | A |
| Example 17 | 3 | TOKUBISHI ART | 21 | 80 | 500 | 113 | 7 | A | A | A | A |
| Example 18 | 1 | TOKUBISHI ART | 12 | 40 | 1250 | 55 | 7 | A | A | B | B |
| Example 19 | 2 | TOKUBISHI ART | 16 | 40 | 1250 | 74 | 7 | A | A | A | B |
| Example 20 | 3 | TOKUBISHI ART | 21 | 40 | 1250 | 88 | 7 | A | A | A | A |
| Example 21 | 1 | TOKUBISHI ART | 12 | 60 | 1250 | 58 | 7 | A | A | B | B |
| Example 22 | 2 | TOKUBISHI ART | 16 | 60 | 1250 | 77 | 7 | A | A | A | B |
| Example 23 | 3 | TOKUBISHI ART | 21 | 60 | 1250 | 92 | 7 | A | A | A | A |
| Example 24 | 1 | TOKUBISHI ART | 12 | 80 | 1250 | 62 | 7 | A | A | B | B |
| Example 25 | 2 | TOKUBISHI ART | 16 | 80 | 1250 | 80 | 7 | A | A | A | B |
| Example 26 | 3 | TOKUBISHI ART | 21 | 80 | 1250 | 95 | 7 | A | A | A | A |
| Example 27 | 1 | TOKUBISHI ART | 12 | 40 | 2500 | 45 | 7 | A | B | B | B |
| Example 28 | 1 | TOKUBISHI ART | 12 | 40 | 2500 | 35 | 5 | A | B | B | B |
| Example 29 | 1 | TOKUBISHI ART | 12 | 40 | 2500 | 25 | 3 | A | B | B | B |
| Example 30 | 2 | TOKUBISHI ART | 16 | 40 | 2500 | 64 | 7 | A | A | B | B |
| Example 31 | 3 | TOKUBISHI ART | 21 | 40 | 2500 | 74 | 7 | A | A | B | A |
| Example 32 | 1 | TOKUBISHI ART | 12 | 60 | 2500 | 47 | 7 | B | A | B | B |
| Example 33 | 2 | TOKUBISHI ART | 16 | 60 | 2500 | 64 | 7 | A | A | B | B |
| Example 34 | 3 | TOKUBISHI ART | 21 | 60 | 2500 | 77 | 7 | A | A | B | B |
| Example 35 | 1 | TOKUBISHI ART | 12 | 80 | 2500 | 50 | 7 | A | B | B | B |
| Example 36 | 2 | TOKUBISHI ART | 16 | 80 | 2500 | 66 | 7 | A | A | B | B |
| Example 37 | 3 | TOKUBISHI ART | 21 | 80 | 2500 | 80 | 7 | A | A | B | B |

(*1): Ink set 1 = cyan pigment ink C-1 + magenta pigment ink M-1 + yellow pigment ink Y-1 + black pigment ink K-1

Ink set 2 = cyan pigment ink C-2 + magenta pigment ink M-2 + yellow pigment ink Y-2 + black pigment ink K-2

Ink set 3 = cyan pigment ink C-3 + magenta pigment ink M-3 + yellow pigment ink Y-3 + black pigment ink K-3

(*2): Conveyance speed at the time of ink drying treatment

TABLE 2

| | Ink set (*1) | Recording medium | Solid content of ink [mass %] | Image region temperature [° C.] | Conveyance speed (*2) [mm/s] | Tackiness [mm] | Time from Image Formation [sec] | Image quality | Surface gloss | Abrasion resistance | Offset resistance |
|---|---|---|---|---|---|---|---|---|---|---|---|
| Example 38 | 1 | OK TOPCOAT+ | 12 | 40 | 500 | 82 | 7 | A | A | A | B |
| Example 39 | 2 | OK TOPCOAT+ | 16 | 60 | 500 | 93 | 7 | A | A | A | B |
| Example 40 | 2 | OK TOPCOAT+ | 16 | 80 | 500 | 98 | 7 | A | A | A | B |
| Example 41 | 3 | OK TOPCOAT+ | 21 | 80 | 500 | 115 | 7 | A | A | A | A |
| Example 42 | 3 | OK TOPCOAT+ | 21 | 80 | 1250 | 88 | 7 | A | A | B | A |
| Example 43 | 3 | OK TOPCOAT+ | 21 | 80 | 2500 | 47 | 7 | A | A | B | B |
| Example 44 | 4 | TOKUBISHI ART | 7.5 | 40 | 500 | 30 | 7 | B | B | B | B |
| Comp. Ex. 1 | 5 | U-LITE | 7 | 15 | 500 | 12 | 7 | C | B | B | C |
| Comp. Ex. 2 | 5 | U-LITE | 7 | 40 | 500 | 15 | 7 | D | C | C | C |
| Comp. Ex. 3 | 6 | U-LITE | 9 | 15 | 500 | 15 | 7 | D | C | C | C |
| Comp. Ex. 4 | 6 | U-LITE | 9 | 40 | 1000 | 10 | 7 | D | D | D | C |
| Comp. Ex. 5 | 5 | TOKUBISHI ART | 7 | 15 | 500 | 12 | 7 | C | B | B | C |
| Comp. Ex. 6 | 5 | TOKUBISHI ART | 7 | 40 | 500 | 15 | 7 | D | C | C | C |
| Comp. Ex. 7 | 6 | TOKUBISHI ART | 9 | 15 | 500 | 15 | 7 | D | C | C | C |
| Comp. Ex. 8 | 6 | TOKUBISHI ART | 9 | 40 | 1000 | 10 | 7 | D | D | D | D |
| Comp. Ex. 9 | 5 | OK TOPCOAT+ | 7 | 15 | 500 | 12 | 7 | C | B | B | C |
| Comp. Ex. 10 | 5 | OK TOPCOAT+ | 7 | 40 | 500 | 15 | 7 | D | C | C | C |

TABLE 2-continued

| | Ink set (*1) | Recording medium | Solid content of ink [mass %] | Image region temperature [° C.] | Conveyance speed (*2) [mm/s] | Tackiness [mm] | Time from Image Formation [sec] | Image quality | Surface gloss | Abrasion resistance | Offset resistance |
|---|---|---|---|---|---|---|---|---|---|---|---|
| Comp. Ex. 11 | 6 | OK TOPCOAT+ | 9 | 15 | 500 | 5 | 7 | D | C | C | C |
| Comp. Ex. 12 | 6 | OK TOPCOAT+ | 9 | 40 | 1000 | 10 | 7 | D | D | D | D |

(*1): Ink set 1 = cyan pigment ink C-1 + magenta pigment ink M-1 + yellow pigment ink Y-1 + black pigment ink K-1
Ink set 2 = cyan pigment ink C-2 + magenta pigment ink M-2 + yellow pigment ink Y-2 + black pigment ink K-2
Ink set 3 = cyan pigment ink C-3 + magenta pigment ink M-3 + yellow pigment ink Y-3 + black pigment ink K-3
Ink set 4 = cyan pigment ink C-4 + magenta pigment ink M-4 + yellow pigment ink Y-4 + black pigment ink K-4
Ink set 5 = cyan pigment ink C-5 + magenta pigment ink M-5 + yellow pigment ink Y-5 + black pigment ink K-5
Ink set 6 = cyan pigment ink C-6 + magenta pigment ink M-6 + yellow pigment ink Y-6 + black pigment ink K-6
(*2): Conveyance speed at the time of ink drying treatment
Comp. Ex.: Comparative Example Table 1 and Table 2 indicate the following.

When coated paper was used in the Examples, line images with uniform width were obtained; further, occurrence of density unevenness was suppressed when solid image recording was performed, as a result of which a uniform and high density image was obtained. Furthermore, image fluctuation due to offset was suppressed, the gloss of the overall image was good, and the abrasion resistance was also good.

On the contrary, the Comparative Examples exhibited inferior results in density unevenness, image printing properties and gloss, and the offset resistance and abrasion resistance of the image were also inferior.

According to the invention, an inkjet recording method which is capable of preventing offset at the time of fixing the image region and is capable of increasing the recording speed while maintaining the image quality can be provided.

Embodiments of the invention include the following.

<1> An inkjet recording method comprising:

recording an image by applying an ink including a pigment to a recording medium; and fixing an image region by pressure-contacting a pressure-bonding unit against the image region when the tackiness of the image region as measured by a ball tack test method reaches 20 mm or greater.

<2> The inkjet recording method according to <1>, wherein the tackiness of the image region measured by the ball tack test method reaches 20 mm or greater within 7 seconds from completion of recording.

<3> The inkjet recording method according to <1> or <2>, wherein the ink further includes a resin particle.

<4> The inkjet recording method according to any one of <1> to <3>, further comprising regulating the temperature of the image region to be 40° C. or higher before the fixing of the image region.

<5> The inkjet recording method according to any one of <1> to <4>, wherein the concentration of solid content of the ink including the pigment is 8% by mass or more.

<6> The inkjet recording method according to any one of <1> to <5>, wherein the recording medium is selected from papers having a coating layer.

<7> The inkjet recording method according to any one of <1> to <6>, further comprising applying a treatment liquid including an aggregating agent which aggregates a component of the ink, to the recording medium.

<8> The inkjet recording method according to <7>, wherein after the applying of the treatment liquid to the recording medium, the recording of the image by applying the ink is performed, and then the fixing of the recorded image region is performed.

<9> The inkjet recording method according to any one of <1> to <8>, wherein the fixing of the image region is performed by heating together with the pressure-contacting.

<10> The inkjet recording method according to any one of <1> to <9>, wherein the content of the pigment in the ink is from 1 to 25% by mass relative to the total amount of the ink <11> The inkjet recording method according to any one of <1> to <10>, wherein the pigment in the ink is an encapsulated pigment.

<12> The inkjet recording method according to any one of <1> to <11>, wherein the ink includes at least one water-soluble organic solvent.

<13> The inkjet recording method according to <3>, wherein the resin particle in the ink includes a self-dispersing polymer.

<14> The inkjet recording method according to <13>, wherein the content of water-soluble component of the self-dispersing polymer that exhibits water-solubility when the self-dispersing polymer is in a dispersed state, is 10% by mass or less relative to the total amount of the self-dispersing polymer.

<15> The inkjet recording method according to any one of <1> to <14>, wherein the ink includes water, and the content of the water is from 10% by mass to 99% by mass relative to the total amount of the ink.

All publications, patent applications, and technical standards mentioned in this specification are herein incorporated by reference to the same extent as if each individual publication, patent application, or technical standard was specifically and individually indicated to be incorporated by reference.

What is claimed is:

1. An inkjet recording method comprising:

applying an ink including a pigment to a recording medium to form an image region; and fixing the image region by pressure-contacting a pressure-bonding unit against the image region when the tackiness of the image region as measured by a ball tack test method reaches 20 mm or greater.

2. The inkjet recording method according to claim 1, wherein the tackiness of the image region measured by the ball tack test method reaches 20 mm or greater within 7 seconds from completion of the recording.

3. The inkjet recording method according to claim 1, wherein the ink further includes a resin particle.

4. The inkjet recording method according to claim 1, further comprising regulating the temperature of the image region to be 40° C. or higher before the fixing of the image region.

5. The inkjet recording method according claim 1, wherein the concentration of solid content of the ink including the pigment is 8% by mass or more.

6. The inkjet recording method according to claim 1, wherein the recording medium is selected from papers having a coating layer.

7. The inkjet recording method according to claim 1, further comprising applying a treatment liquid including an aggregating agent which aggregates a component of the ink, to the recording medium.

8. The inkjet recording method according to claim 7, wherein after the applying of the treatment liquid to the recording medium, the recording of the image by applying the ink is performed, and then the fixing of the recorded image region is performed.

9. The inkjet recording method according to claim 1, wherein the fixing of the image region is performed by heating together with the pressure-contacting.

10. The inkjet recording method according to claim 1, wherein the content of the pigment in the ink is from 1 to 25% by mass relative to the total amount of the ink.

11. The inkjet recording method according to claim 1, wherein the pigment in the ink is an encapsulated pigment.

12. The inkjet recording method according to claim 1, wherein the ink includes at least one water-soluble organic solvent.

13. The inkjet recording method according to claim 3, wherein the resin particle in the ink includes a self-dispersing polymer.

14. The inkjet recording method according to claim 13, wherein the content of water-soluble component of the self-dispersing polymer that exhibits water-solubility when the self-dispersing polymer is in a dispersed state, is 10% by mass or less relative to the total amount of the self-dispersing polymer.

15. The inkjet recording method according to claim 1, wherein the ink includes water, and the content of the water is from 10% by mass to 99% by mass relative to the total amount of the ink.

* * * * *